US011592770B2

(12) United States Patent
Shimada et al.

(10) Patent No.: US 11,592,770 B2
(45) Date of Patent: Feb. 28, 2023

(54) PRESSING DEVICE, FIXING DEVICE, AND IMAGE FORMING APPARATUS INCORPORATING FIXING DEVICE

(71) Applicants: Hiroyuki Shimada, Tokyo (JP); Yukimichi Someya, Saitama (JP); Yuusuke Furuichi, Kanagawa (JP); Daisuke Inoue, Tokyo (JP); Satoshi Tohkai, Kanagawa (JP); Yumiko Hayashi, Kanagawa (JP)

(72) Inventors: Hiroyuki Shimada, Tokyo (JP); Yukimichi Someya, Saitama (JP); Yuusuke Furuichi, Kanagawa (JP); Daisuke Inoue, Tokyo (JP); Satoshi Tohkai, Kanagawa (JP); Yumiko Hayashi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/692,177

(22) Filed: Mar. 11, 2022

(65) Prior Publication Data

US 2022/0299920 A1 Sep. 22, 2022

(30) Foreign Application Priority Data

Mar. 19, 2021 (JP) ..... JP2021-045833
Jan. 31, 2022 (JP) ..... JP2022-013114

(51) Int. Cl.
*G03G 15/20* (2006.01)

(52) U.S. Cl.
CPC ..... *G03G 15/2064* (2013.01)

(58) Field of Classification Search
None
See application file for complete search history.

(56) References Cited

U.S. PATENT DOCUMENTS

2003/0170054 A1* 9/2003 Suzuki ..... G03G 15/2064 399/328
2012/0230742 A1* 9/2012 Nakagawa ..... B32B 27/34 399/329
2014/0023390 A1* 1/2014 Hirado ..... G03G 15/2039 399/70

(Continued)

FOREIGN PATENT DOCUMENTS

JP 5-080666 4/1993
JP 2001-223063 8/2001

(Continued)

*Primary Examiner* — Sevan A Aydin
(74) *Attorney, Agent, or Firm* — Xsensus LLP

(57) ABSTRACT

A fixing device includes a rotator, a secured member, a pressure rotator, and lubricant. The rotator has flexibility and a sleeve form. The rotator includes an inner portion having a sliding surface. The inner portion has an elastic power of 55% or more. The secured member is disposed inside a loop of the rotator and has a slide surface on which the sliding surface of the rotator slides. The slide surface has a larger hardness than a hardness of the sliding surface of the rotator. The pressure rotator presses the rotator against the secured member and forms a nip between the rotator and the pressure rotator. The lubricant is provided between the rotator and the secured member.

16 Claims, 18 Drawing Sheets

(56) References Cited

U.S. PATENT DOCUMENTS

| | | | | |
|---|---|---|---|---|
| 2014/0023395 | A1* | 1/2014 | Ikeda | G03G 15/757 399/111 |
| 2014/0286684 | A1* | 9/2014 | Takagi | G03G 15/2053 399/329 |
| 2015/0078794 | A1 | 3/2015 | Natori et al. | |
| 2015/0110531 | A1* | 4/2015 | Takagi | G03G 15/2053 399/329 |
| 2020/0249604 | A1 | 8/2020 | Adachi et al. | |
| 2020/0292972 | A1 | 9/2020 | Inoue et al. | |
| 2020/0292973 | A1* | 9/2020 | Furuichi | G03G 15/2053 |
| 2020/0393782 | A1* | 12/2020 | Nakamura | G03G 15/2053 |
| 2020/0409292 | A1* | 12/2020 | Fujimoto | G03G 15/2025 |

FOREIGN PATENT DOCUMENTS

| | | | | |
|---|---|---|---|---|
| JP | 2002-134264 | | 5/2002 | |
| JP | 2003-233264 | | 8/2003 | |
| JP | 2009-014893 | | 1/2009 | |
| JP | 2012-088463 | | 5/2012 | |
| JP | 2013-213904 | | 10/2013 | |
| JP | 2013213904 | A * | 10/2013 | G03G 15/2057 |
| JP | 2014-174358 | | 9/2014 | |
| JP | 2014-189601 | | 10/2014 | |
| JP | 2015-038550 | | 2/2015 | |
| JP | 2020-122928 | | 8/2020 | |

* cited by examiner $$Sa = \frac{1}{A}\iint_A |Z(x,y)|\,dxdy$$

FIG. 11A
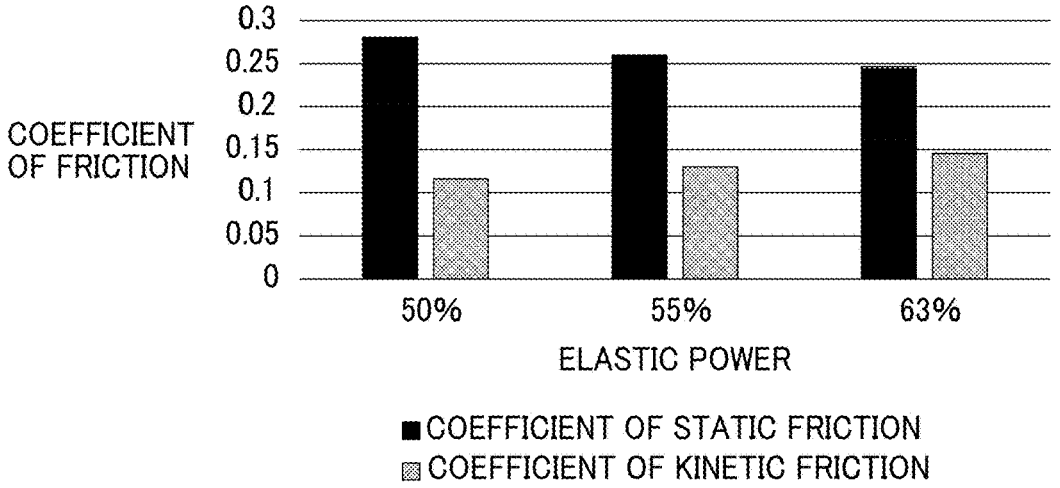
FIG. 11B
| ELASTIC POWER | 50% | 55% | 63% |
|---|---|---|---|
| ABNORMAL NOISE | NO PROBLEM | NO PROBLEM | NO PROBLEM |
| VIBRATION | OCCURRED | NONE | NONE |
FIG. 11C
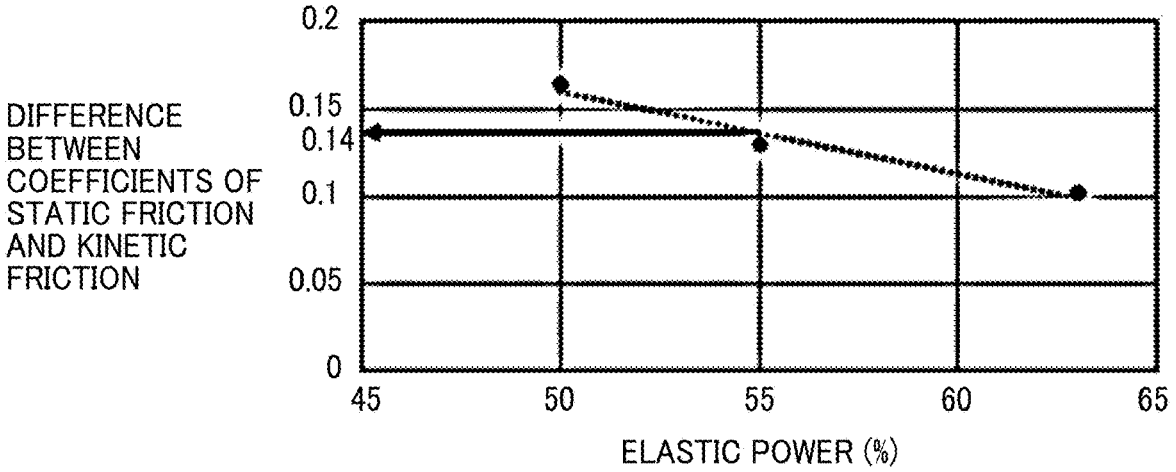

PRESSING DEVICE, FIXING DEVICE, AND IMAGE FORMING APPARATUS INCORPORATING FIXING DEVICE

CROSS-REFERENCE TO RELATED APPLICATIONS

This patent application is based on and claims priority pursuant to 35 U.S.C. § 119(a) to Japanese Patent Applications No. 2021-045833, filed on Mar. 19, 2021, and No. 2022-013114, filed on Jan. 31, 2022, in the Japan Patent Office, the entire disclosure of each of which is incorporated by reference herein.

BACKGROUND

Technical Field

Embodiments of the present disclosure relate to a pressing device, a fixing device, and an image forming apparatus, and more particularly to the pressing device including a rotator such as a fixing belt having an improved slidability and reducing abnormal noise while the rotator slides on something and the image forming apparatus including the fixing device as the pressing device.

Related Art

Electrophotographic image forming apparatuses use various types of fixing devices. One type of fixing devices uses a slide fixing method in which a heater heats a thin fixing belt having a low thermal capacity. As the heater, a halogen lamp or a planar heater is used. The fixing device includes a pressure roller as a pressure rotator disposed outside the fixing belt. The fixing belt is interposed between the pressure roller and a slide portion on which an inner circumferential surface of the fixing belt slides to form a fixing nip between the pressure roller and the slide portion.

SUMMARY

This specification describes an improved pressing device that includes a rotator, a secured member, a pressure rotator, and lubricant. The rotator has flexibility and a sleeve form. The rotator includes an inner portion having a sliding surface. The inner portion has an elastic power of 55% or more. The secured member is disposed inside a loop of the rotator and has a slide surface on which the sliding surface of the rotator slides. The slide surface has a larger hardness than a hardness of the sliding surface of the rotator. The pressure rotator presses the rotator against the secured member and forms a nip between the rotator and the pressure rotator. The lubricant is provided between the rotator and the secured member.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 11A is a graph illustrating a relation between the elastic power and coefficients of static and kinetic friction:

FIG. 11B is a table illustrating a relation between the elastic power and occurrence of abnormal noise and vibration;

FIG. 11C is a graph illustrating a relation between the elastic power and a difference between the coefficient of static friction and the coefficient of kinetic friction:

Figure 1A:
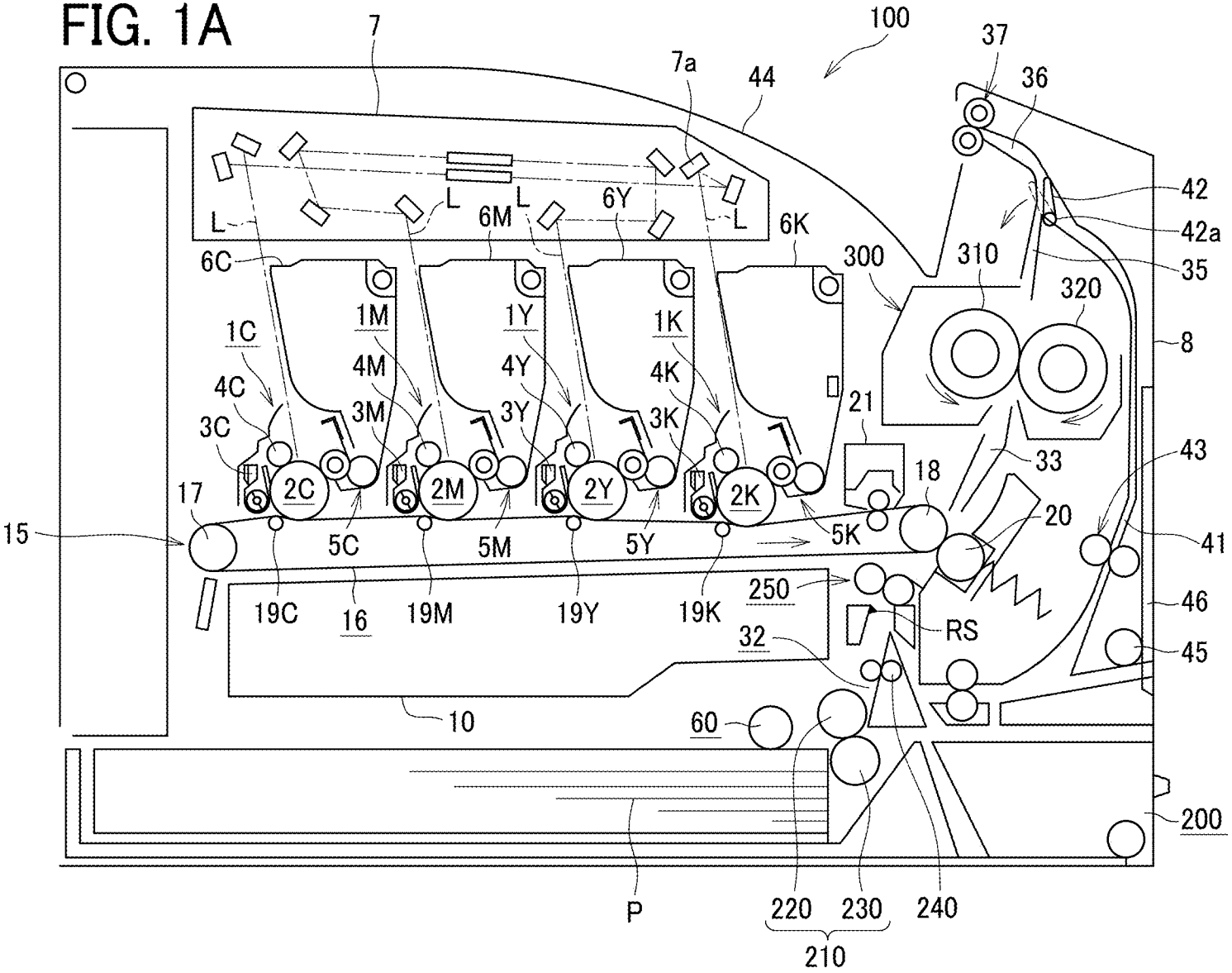
FIG. 1A is a schematic diagram illustrating a configuration of an image forming 1, apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Referring now to the drawings, embodiments of the present disclosure are described below. As used herein, the singular forms "a," "an," and "the" are intended to include the plural forms as well, unless the context clearly indicates otherwise.

With reference to drawings, a description is given of a heating device according to embodiments of the present disclosure, a fixing device using the heating device, and an image forming apparatus such as a laser printer using the heating device. The "heating device" in the present embodiments means a device that heats a sheet with a heat generator. The "fixing device" means a device that conveys the sheet in a direction orthogonal to the longitudinal direction to a nip formed between the heating device and a pressure member and fixes unfixed toner applied to the sheet onto the sheet. The "image forming apparatus" means an apparatus that includes the fixing device and applies developer or ink to the sheet to form an image on the sheet as a recording medium on which an image is recorded.

The laser printer is just an example of the image forming apparatus, and thus the image forming apparatus is not limited to the laser printer. In other words, the image forming apparatus may be a copier, a facsimile machine, a printer, a plotter, an inkjet recording apparatus, or a multifunction peripheral having at least two of copying, printing, facsimile transmission, plotting, scanning, and inkjet recording capabilities.

The identical or similar parts in each drawing are designated by the same reference numerals, and the duplicate description thereof is appropriately simplified or omitted. Further, size (dimension), material, shape, and relative positions used to describe each of the components and units are examples, and the scope of the present disclosure is not limited thereto unless otherwise specified.

Although a "recording medium" is described as a "sheet" in the following embodiments, the "recording medium" is not limited to the sheet of paper. Examples of the "recording medium" include not only the sheet of paper but also an overhead projector (OHP) transparency sheet, a fabric, a metallic sheet, a plastic film, and a prepreg sheet including carbon fibers previously impregnated with resin.

Examples of the "recording medium" include all media to which developer or ink can be adhered, and so-called recording paper and recording sheets. Examples of the "sheet" include thick paper, a postcard, an envelope, thin paper, coated paper (e.g., coat paper and art paper), and tracing paper, in addition to plain paper.

The term "image forming" used in the following description means not only giving an image having a meaning, such as a character or a figure, to a medium but also giving an arbitrary image having no meaning, such as a pattern, to a medium.

(Configuration of Image Forming Apparatus)

Figure 1B:
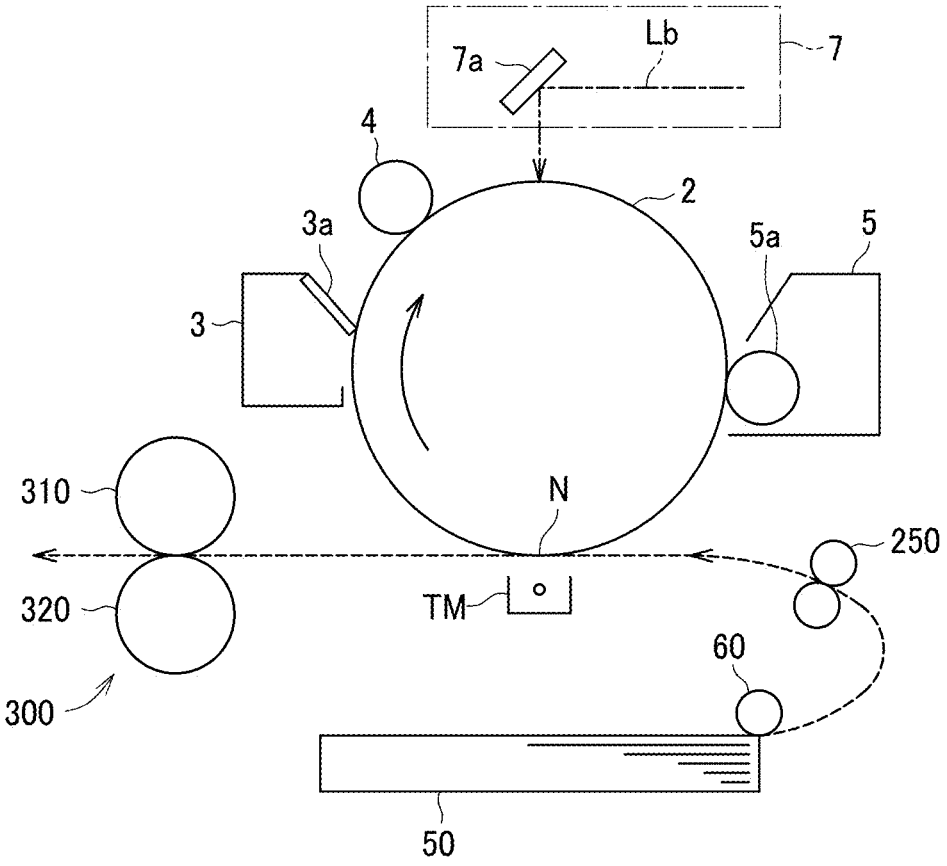
FIG. 1B is a schematic diagram illustrating the principle of how an image forming apparatus operates, according to an embodiment of the present disclosure.

FIG. 1A is a schematic diagram illustrating a configuration of an image forming apparatus 100 (illustrated as a laser printer) including a fixing device 300 that includes the heating device according to an embodiment of the present disclosure. FIG. 1B illustrates the principle of an operation in the laser printer (as the image forming apparatus according to the present embodiment).

The image forming apparatus 100 includes four process units 1K, 1Y, 1M, and 1C as image forming devices. Suffixes, which are K, Y, M, and C, are used to indicate respective colors of toners (black, yellow, magenta, and cyan toners in this example) for the process units. The process units 1K, 1Y, 1M, and 1C form images of color toners of black (K), yellow (Y), magenta (M), and cyan (C) corresponding to color separation components of a color image.

The process units 1K, 1Y, 1M, and 1C respectively include toner bottles 6K, 6Y, 6M, and 6C containing different color toners. The process units 1K, 1Y, 1M, and 1C have a similar structure except the color of toner. Thus, the configuration of the one process unit 1K is described below, and the descriptions of the other process units 1Y, 1M, and 1C are omitted.

The process unit 1K includes an image bearer 2K such as a photoconductor drum, a photoconductor cleaner 3K, and a discharger. The process unit 1K further includes a charging device 4K as a charger that uniformly charges the surface of the image bearer and a developing device 5K as a developing unit that renders visible an electrostatic latent image formed on the image bearer. The process unit 1K is detachably attachable to a main body of the image forming apparatus 100. Consumable parts of the process unit 1K can be replaced at one time.

An exposure device 7 is disposed above the process units 1K, 1Y, 1M, and 1C in the image forming apparatus 100. The exposure device 7 performs writing and scanning based on image data, in other words, irradiates the image bearer 2K with laser light L emitted by a laser diode and reflected by mirrors 7*a* based on the image data.

A transfer device 15 is disposed below the process units 1K, 1Y, 1M, and 1C in the present embodiment. The transfer device 15 corresponds to a transfer unit TM in FIG. 1B. Primary transfer rollers 19K, 19Y, 19M, and 19C are disposed opposite the image bearers 2K, 2Y, 2M, and 2C, respectively, to contact an intermediate transfer belt 16.

The intermediate transfer belt 16 is stretched around and entrained by the primary transfer rollers 19K, 19Y, 19M, and 19C, a drive roller 18, and a driven roller 17 to rotate in a circulating manner. A secondary transfer roller 20 is disposed opposite the drive roller 18 to contact the intermediate transfer belt 16. Note that, when the image bearers 2K, 2Y, 2M, and 2C serve as primary image bearers to bear images of the respective colors, the intermediate transfer belt 16 serves as a secondary image bearer to bear a composite image in which the images on the respective image bearers 2K, 2Y, 2M, and 2C are superimposed one on another.

A belt cleaner 21 is disposed downstream from the secondary transfer roller 20 in a direction of rotation of the intermediate transfer belt 16. A cleaning backup roller is disposed opposite the belt cleaner 21 via the intermediate transfer belt 16.

A sheet feeder 200 including a tray loaded with sheets P is disposed in a lower portion of the image forming apparatus 100. The sheet feeder 20M serves as a recording-medium supply device and can store a bundle of a large number of sheets P as recording media. The sheet feeder 200 is integrated as a single unit together with a sheet feed roller 60 and a roller pair 210 as a conveyor for the sheets P.

The sheet feeder 200 is detachably inserted in the main body of the image forming apparatus 100 to supply the sheet. The sheet feed roller 60 and the roller pair 210 are disposed at an upper portion of the sheet feeder 200 and convey the uppermost one of the sheets P in the sheet feeder 200 to a sheet feeding path 32.

A registration roller pair 250 as a separation conveyor is disposed near the secondary transfer roller 20 and upstream from the secondary transfer roller 20 in a sheet conveyance direction and can temporarily stop the sheet P fed from the sheet feeder 200. Temporarily stopping the sheet P causes slack on the leading end of the sheet P and corrects a skew of the sheet P.

A registration sensor RS is disposed immediately upstream from the registration roller pair 250 in the sheet conveyance direction and detects passage of a leading end of the sheet. When a predetermined time passes after the registration sensor RS detects the passage of the leading end of the sheet, the sheet contacts the registration roller pair 250 and temporarily stops.

Conveyance rollers 240 are disposed downstream from the sheet feeder 200 to convey the sheet conveyed to the right side from the roller pair 210 upward. As illustrated in FIG. 1A, the conveyance rollers 240 convey the sheet to the registration roller pair 250 upward.

The roller pair 210 includes a pair of an upper roller and a lower roller. The roller pair 210 can adopt a friction reverse roller (feed and reverse roller (FRR)) separation system or a friction roller (FR) separation system.

In the FRR separation system, a separation roller (a return roller) is applied with a certain amount of torque in a counter sheet feeding direction from a driving shaft via a torque limiter and pressed against a feed roller to separate sheets in a nip between the separation roller and the feed roller. In the FR separation system, the separation roller (a friction roller) is supported by a secured shall via a torque limiter and pressed against a feed roller to separate sheets in a nip between the separation roller and the feed roller.

The roller pair 210 in the present embodiment is configured as the FRR separation system. That is, the roller pair 210 includes a feed roller 220 and a separation roller 230. The feed roller 220 is an upper roller of the roller pair 210 and conveys a sheet toward an inner side of the image forming apparatus 100. The separation roller 230 is a lower roller of the roller pair 210. A driving force acting in a direction opposite a direction in which a driving force is given to the feed roller 220 is given to the separation roller 230 by a drive shaft through a torque limiter.

The separation roller 230 is pressed against the feed roller 220 by a biasing member such as a spring. A clutch transmits the driving force of the feed roller 220 to the sheet feed roller 60. Thus, the sheet feed roller 60 rotates counterclockwise in FIG. 1A.

The registration roller pair 250 feeds the sheet P, which has contacted the registration roller pair 250 and has been slackened at the leading-edge side of the sheet P, toward a secondary transfer nip between the secondary transfer roller 20 and the drive roller 18, which is illustrated as a transfer nip N in FIG. 1B, at a suitable timing to transfer a toner image on the intermediate transfer belt 16 onto the sheet P. A bias applied at the secondary transfer nip electrostatically transfers the toner image formed on the intermediate transfer belt 16 onto the fed sheet P at a desired transfer position with high accuracy.

A post-transfer conveyance path 33 is disposed above the secondary transfer nip between the secondary transfer roller 20 and the drive roller 18. The fixing device 300 is disposed near an upper end of the post-transfer conveyance path 33.

The fixing device 300 includes a fixing belt 310 as a fixing rotator, the beating device inside a loop of the fixing belt 310, and a pressure roller 320 as a pressure rotator that rotates while contacting the fixing belt 310 with a predetermined pressure. The fixing device 300 is one type of pressing device. The fixing device 300 can be of various types as illustrated in FIG. 2A to FIG. 2D, which will be described later. First, the fixing device 300 is described according to the type illustrated in FIG. 2A.

A post-fixing conveyance path 35 is disposed above the fixing device 3M) and branches into a sheet ejection path 36 and a reverse conveyance path 41 at the upper end of the post-fixing conveyance path 35. At this branching portion, a switching member 42 is disposed and pivots on a pivot shaft 42*a*. At an opening end of the sheet ejection path 36, a pair of sheet ejection rollers 37 is disposed.

The reverse conveyance path 41 begins from the branching portion and converges into the sheet feeding path 32. Additionally, a reverse conveyance roller pair 43 is disposed midway in the reverse conveyance path 41. An upper face of the image forming apparatus 100 is recessed to an inner side of the image forming apparatus 100 and serves as a sheet ejection tray 44.

A powder container 10 such as a toner container is disposed between the transfer device 15 and the sheet feeder 200. The powder container 10 is removably installed in the housing of the image forming apparatus 100.

The image forming apparatus 100 according to the present embodiment has a predetermined distance from the sheet feed roller 60 to the secondary transfer roller 20 in consideration of the conveyance of a sheet on which a toner image is to be transferred. The powder container 10 is disposed in a dead space caused by the predetermined distance to keep the entire image forming apparatus compact.

A transfer cover 8 is disposed above the sheet feeder 200 and on a front side in a direction to which the sheet feeder 200 is pulled out. The transfer cover 8 can be opened to check an interior of the image forming apparatus 100. The transfer cover 8 includes a bypass feed roller 45 for bypass sheet feeding and a bypass feed tray 46 for the bypass sheet feeding.

(Operation of Image Forming Apparatus)

Next, a basic operation of the image forming apparatus (illustrated as the laser printer) according to the present embodiment is described below with reference to FIG. 1A. First, operations of a simplex or single-sided printing are described.

Referring to FIG. 1A, the sheet feed roller 60 rotates according to a sheet feeding signal from a controller of the image forming apparatus 100. The sheet feed roller 60 separates the uppermost sheet from a bundle of sheets P (also referred to as sheet bundle) loaded in the sheet feeder 200 and feeds the uppermost sheet to the sheet feeding path 32.

When the leading edge of the sheet P, which has been fed by the sheet feed roller 60 and the roller pair 210, reaches a nip of the registration roller pair 250, the sheet P is slackened and temporarily stopped by the registration roller pair 250. The registration roller pair 250 corrects the skew on the leading-edge side of the sheet P and rotates in synchronization with an optimum timing so that a toner image formed on the intermediate transfer belt 16 is transferred onto the sheet P.

When the sheet P is fed from the bypass feed tray 46, sheets P of the sheet bundle loaded on the bypass feed tray 46 are fed one by one from the uppermost sheet of the sheet bundle by the bypass feed roller 45. Then, the sheet P passes a part of the reverse conveyance path 41 and is conveyed to the nip of the registration roller pair 250. The subsequent operations are the same as the sheet feeding operations from the sheet feeder 200.

As to image formation, operations of the process unit 1K are described as representative, and descriptions of the other process units 1Y, 1M, and 1C are omitted here. First, the charging device 4K uniformly charges the surface of the image bearer 2K to high potential. The exposure device 7 irradiates the surface of the image bearer 2K with laser light L according to image data.

The surface of the image bearer 2K irradiated with the laser light L has an electrostatic latent image due to a drop in the potential of the irradiated portion. The developing device 5K includes a developer bearer to bear a developer including toner and transfers unused black toner supplied from the toner bottle 6K onto the irradiated portion of the surface of the image bearer 2K having the electrostatic latent image, through the developer bearer.

The image bearer 2K to which the toner has been transferred forms (develops) a black toner image on the surface of the image bearer 2K. The black toner image formed on the image bearer 2K is transferred onto the intermediate transfer belt 16.

The photoconductor cleaner 3K removes residual toner remaining on the surface of the image bearer 2K after an intermediate transfer operation. The removed residual toner is conveyed by a waste toner conveyor and collected to a waste toner container in the process unit 1K. The discharger discharges the remaining charge on the image bearer 2K from which the remaining toner is removed by the photoconductor cleaner 3K.

Similarly, toner images are formed on the image bearers 2Y, 2M, and 2C in the process units 1Y, 1M, and 1C for the colors, and color toner images are transferred to the intermediate transfer belt 16 such that the color toner images are superimposed on one on another.

The intermediate transfer belt 16 on which the color toner images are transferred and superimposed travels such that the color toner images reach the secondary transfer nip between the secondary transfer roller 20 and the drive roller 18. The registration roller pair 250 rotates to nip the sheet P contacting the registration roller pair 250 at a predetermined timing and conveys the sheet P to the secondary transfer nip of the secondary transfer roller 20 at a suitable timing such that a composite toner image formed by superimposing and transferring the toner images on the intermediate transfer belt 16 is transferred onto the sheet P. In this manner, the composite toner image on the intermediate transfer belt 16 is transferred to the sheet P sent out by the registration roller pair 250.

The sheet P having the transferred composite toner image is conveyed to the fixing device 300 through the post-transfer conveyance path 33. The sheet P conveyed to the fixing device 300 is nipped by the fixing belt 310 and the pressure roller 320. The unfixed toner image is fixed onto the sheet P under heat and pressure in the fixing device 300. The sheet P, on which the composite toner image has been fixed, is sent out from the fixing device 300 to the post-fixing conveyance path 35.

When the fixing device 30) sends out the sheet P, the switching member 42 is at a position at which the upper end of the post-fixing conveyance path 35 is open, as indicated by the solid line of FIG. 1A. The sheet P sent out from the fixing device 300 is sent to the sheet ejection path 36 via the post-fixing conveyance path 35. The pair of sheet ejection rollers 37 nip the sheet P sent out to the sheet ejection path 36 and rotate to eject the sheet P to the sheet ejection tray 44. Thus, the single-sided printing is finished.

Next, a description is given of operations of a duplex or double-sided printing. Similar to the single-sided printing described above, the fixing device 300 sends out the sheet P to the sheet ejection path 36. In the duplex printing, each of the pair of sheet ejection rollers 37 rotates in a direction to convey a part of the sheet P outside the image forming apparatus 100.

When the trailing edge of the sheet P passes through the sheet ejection path 36, the switching member 42 pivots on the pivot shaft 42*a* as indicated with a broken line in FIG. 1A to close the upper end of the post-fixing conveyance path 35. When the upper end of the post-fixing conveyance path 35 is closed, substantially simultaneously, each of the pair of sheet ejection rollers 37 rotates in reverse (in other words, in a direction opposite to the direction to convey a part of the sheet P outside the image forming apparatus 100) to convey the sheet P to an inner side of the image forming apparatus 100, that is, to the reverse conveyance path 41.

The sheet P sent out to the reverse conveyance path 41 reaches the registration roller pair 250 via the reverse conveyance roller pair 43. The registration roller pair 250 sends out the sheet P to the secondary transfer nip at a suitable timing such that the toner image formed on the intermediate transfer belt 16 is transferred onto the other surface of the sheet P to which no toner image has been transferred.

When the sheet P passes through the secondary transfer nip, the secondary transfer roller 20 and the drive roller 18 transfer the toner image to the other surface (back side) of the sheet P to which no toner image has been transferred. The sheet P having the transferred toner image is conveyed to the fixing device 300 through the post-transfer conveyance path 33.

In the fixing device 300, the sheet P is nipped by the fixing belt 310 and the pressure roller 320, and the unfixed toner image are fixed on the back side of the sheet P under heat and pressure. The sheet P having the toner images fixed to both front and back sides of the sheet P in this manner is sent out from the fixing device 3M) to the post-fixing conveyance path 35.

When the fixing device 300 sends out the sheet P, the switching member 42 is at a position at which the upper end of the post-fixing conveyance path 35 is open, as indicated by the solid line of FIG. 1A. The sheet P sent out from the fixing device 300 is sent to the sheet ejection path 36 via the post-fixing conveyance path 35. The pair of sheet ejection rollers 37 nips the sheet P sent out to the sheet ejection path 36 and rotates to eject the sheet P to the sheet ejection tray 44. Thus, the duplex printing is finished.

After the toner image on the intermediate transfer belt 16 is transferred onto the sheet P, residual toner remains on the intermediate transfer belt 16. The belt cleaner 21 removes the residual toner from the intermediate transfer belt 16. The waste toner conveyor conveys the toner removed from the intermediate transfer belt 16 to the powder container 10, and the toner is collected inside the powder container 10.

(Fixing Device)

Next, the heating device and the fixing devices 300 according to the present embodiment and fixing devices 300A, 300B, and 300C according to other embodiments of the present disclosure are described below. The heating device according to the present embodiment heats the fixing belt 310 in the fixing device 300.

Figure 2A:
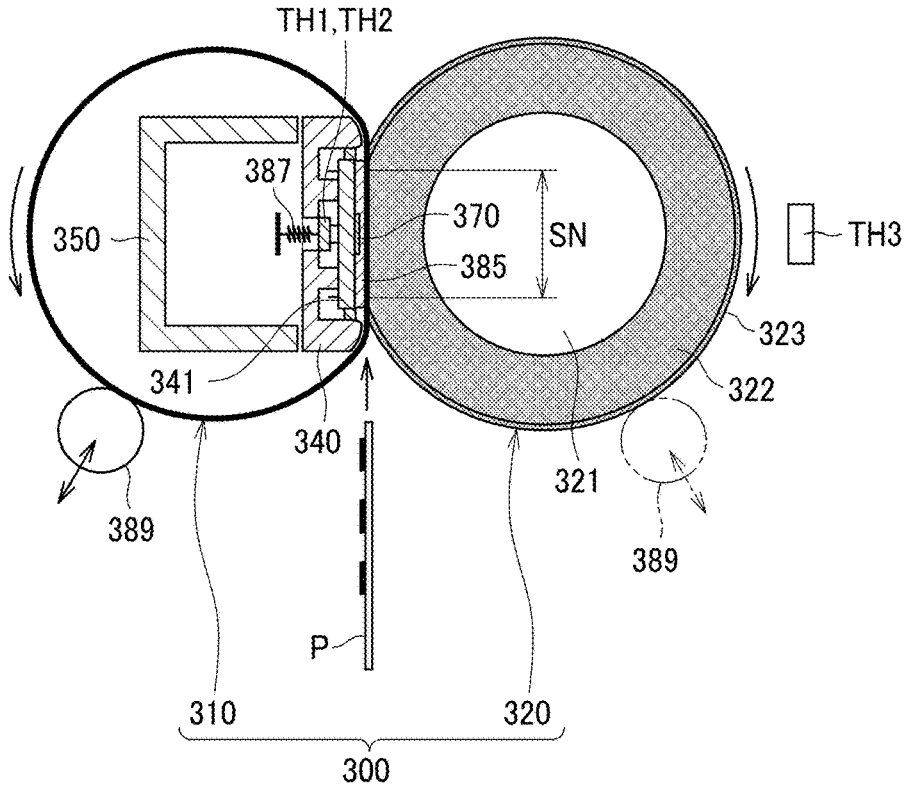
FIG. 2A is a cross-sectional view of a fixing device according to an embodiment of the present disclosure.

As illustrated in FIG. 2A, the fixing device 300 includes a thin fixing belt 310 having low thermal capacity and a pressure roller 320. The fixing belt 310 includes, for example, a tubular base mainly made of polyimide (PI). The tubular base has an outer diameter of 25 mm and a thickness of 40 to 120 μm. The polyimide as a main component can increase elastic power of the base. For example, the base made of polyamide imide (PAI) has the elastic power from 20% to 40%. In contrast, the base made of PI can have the elastic power larger than 50%. The inner surface of the fixing belt 310 including the base made of polyimide may not be coated. The inner surface of the fixing belt 310 including the base made of a material other than polyimide may be coated with paint containing polyimide.

The fixing belt 310 further includes a release layer serving as an outermost surface layer. The release layer is made of fluororesin, such as tetrafluoroethylene-perfluoroalkylvinylether copolymer (PFA) or polytetrafluoroethylene (PTFE), and has a thickness of from 5 μm to 50 μm to enhance durability of the fixing belt 310 and facilitate separation of the sheet P from the fixing belt 310. Optionally, an elastic layer that is made of rubber or the like and has a thickness in a range of from 50 μm to 500 μm may be interposed between the base and the release layer.

Without interposing the elastic layer between the base and the release layer, an adhesive layer may be interposed between the base and the release layer. Since the base made of polyimide has high flexibility, the fixing belt satisfactorily conforms to the shape of a nip inlet. As a result, grease is easily supplied to the fixing belt by capillary action.

Because of heat insulating properties of the elastic layer, the temperature of the inner surface of the fixing belt including the elastic layer, that is, the temperature of a sliding surface of the fixing belt including the elastic layer is higher than the sliding surface of the fixing belt not including the elastic layer when the surface temperature of the fixing belt including the elastic layer is the same as the surface temperature of the fixing belt not including the elastic layer. The high thermal conductivity from the inner surface to the outer surface of the fixing belt not including the elastic layer enables setting the temperature of the heater lower, which is advantageous for the evaporation of the lubricant and can prolong the service life of the belt.

The base of the fixing belt 310 may be made of heat-resistant resin such as polyetheretherketone (PEEK) or metal such as nickel (Ni) or stainless steel (Stainless Used Steel, SUS), instead of polyimide. An inner circumferential surface of the fixing belt 310 may be coated with polyimide, PTFE, or the like to produce a slide layer.

The pressure roller 320 having, for example, an outer diameter of 25 mm, includes a core 321 that is a solid iron core, an elastic layer 322 on the surface of the core 321, and a release layer 323 formed on the outside of the elastic layer 322. The elastic layer 322 is made of silicone rubber (solid rubber) and has, for example, a thickness of 3.5 mm. The thermal conductivity of the solid rubber of the pressure roller 320 in the longitudinal direction is 0.2 to 2.5 W/m·k in the present embodiment.

The thermal conductivity of a foam sponge roller is generally 0.15 W/m·k or less. Therefore, the pressure roller made of solid rubber more preferably transfers heat from a portion in which an excessive temperature rise occurs to another portion in the longitudinal direction than the foam sponge roller and reduces the temperature difference caused by the excessive temperature rise. The excessive temperature rise is likely to occur in a non-sheet passing portion that is a portion with which the sheet passing the fixing device is not in contact. However, the pressure roller with too high thermal conductivity has too high rubber hardness and needs a high load to set the fixing nip, which is not practical as the pressure roller.

The pressure roller made of the solid rubber forms an inner nip longer than an inner nip that the foam sponge roller forms. The inner nip means a contact width between the inner circumferential surface of the fixing belt and a secured member on which the fixing belt slides.

The larger the inner nip width is, the longer the contact time of the inner circumferential surface of the fixing belt with the secured member per one rotation is, which is disadvantageous in terms of the wear of the inner circumferential surface of the fixing belt. In the present embodiment, setting the elastic power of an inner portion of the fixing belt to 55% or more and the hardness H2 of the slide surface of the secured member to be larger than the hardness H1 of a sliding surface of the fixing belt overcomes the disadvantage caused by the large inner nip width (that is an increase of the wear amount of the inner circumferential surface of the fixing belt) compared with the fixing device including the secured member having the hardness H2 smaller than the hardness. In the above, the sliding surface of the fixing belt is the surface of the inner portion of the fixing belt, and the slide surface of the secured member is the surface on which the fixing belt slides. Regarding a measurement method of the hardness, various measurement methods are publicly defined. For example. Japanese Industrial Standards (JIS) includes the measurement methods of the hardness. In the present embodiments, any method may be used as long as the hardness can be compared.

Preferably, the release layer 323 is formed by a fluororesin layer having, for example, a thickness of approximately 40 μm on the surface of the elastic layer 322 to enhance releasability. A biasing member presses the pressure roller 320 against the fixing belt 310.

On the outer circumferential surface of the fixing belt 310, a thermal equalizer 389 that is a roller is disposed so as to be rotatable and separable from the outer circumferential surface of the fixing belt 310. The thermal equalizer 389 reduces temperature unevenness in the axial direction of the fixing belt 310 and is made of a material such as aluminum or copper having high thermal conductivity in the axial direction.

Coating the surface of the thermal equalizer 389 with a material having a high capability to release toner, such as PTFE or PFA, can prevent toner adhesion to the surface of the thermal equalizer 389. The thermal equalizer 389 may be disposed on the outer circumferential surface of the pressure roller 320.

The thermal equalizer 389 may be configured to be driven and rotated by contact with the fixing belt 310 or may be rotated by a driver. The thermal equalizer 389 is in contact with the outer circumferential surface of the fixing belt 310 and transfers heat in the axial direction of the fixing belt 310 to reduce the temperature unevenness of the fixing belt 310, in other words, performs processing to reduce the temperature difference on the fixing belt 310, which is referred to as a temperature difference reduction process and described below.

When the driver drives the thermal equalizer 389, the driver may rotate the thermal equalizer 389 in a peripheral speed different from a peripheral speed of the fixing belt 310, which gives the thermal equalizer 389 a function smoothing the surface of the fixing belt 310. The function prevents an abnormal image called as a "sheet edge scratch" caused by wear of the fixing belt 310 due to the sheet edge. To perform the above-described functions, the thermal equalizer 389 has a width larger than the maximum sheet width and a heat generation width of a resistor 370 that is a heat source (that is, the width of the thermal equalizer 389>the width of the resistor 370>the maximum sheet width).

The temperature difference reduction process in the present embodiment means a process to reduce temperature differences of the fixing belt 310 in the longitudinal direction of a heater 330 and specifically means, for example, each of the following processes. (1) Temporarily stopping the conveyance of the sheet when the temperature difference between temperatures detected by thermistors at two positions of the fixing belt 310 in the longitudinal direction of the heater 330 exceeds an allowable range. (2) Temporarily reducing a sheet conveyance speed when the temperature difference exceeds the allowable range. (3) Temporarily bringing the thermal equalizer 389 into contact with at least one of the fixing belt 310 or the pressure roller 320 when the temperature difference exceeds the allowable range.

The allowable range can be freely set within a range of 5° to 15°, for example. Based on the degree of deviation from the allowable range, it is possible to increase or decrease the time during which the conveyance of the sheet is temporarily stopped, the time during which the conveyance speed of the sheet is temporarily reduced, or the time during which the thermal equalizer 389 is temporarily brought into contact with the fixing belt 310. Or it is possible to increase or decrease the rate at which the sheet conveyance speed is reduced based on the degree of deviation from the allowable range.

The thermal equalizer 389 that is always in contact with the fixing belt 310 or the pressure roller 320 increases the thermal capacity of a part to be heated and prevents the fixing device from quickly starting operations. To avoid the above-described disadvantage, a contact and separation mechanism may be disposed. A controller may control the contact and separation mechanism so that the thermal equalizer 389 is in contact with the at least one of the fixing belt 310 and the pressure roller 320 and rotates when the controller determines performing a thermal equalization process in response to increase in a temperature detected at the non-sheet passing portion.

In particular, the heater including the resistor 370 as the heat source having a width larger than the maximum sheet width to decrease a temperature drop at an end of the fixing belt when the fixing device starts operations is likely to cause an excessive temperature rise at the end of the fixing belt because the positional deviation of the sheet forms the non-sheet passing portion even when the maximum sheet is used. The excessive temperature rise at the end of the fixing belt affects and abnormally increases temperatures at parts of the sheet near the edge of the sheet and is likely to cause uneven gloss at the parts of the sheet. To detect the above-described excessive temperature rise, a monitor thermistor TH2 disposed outside a maximum sheet conveyance span is useful when the fixing device has a single heater configuration and includes the resistor 370 having the width larger than the maximum sheet width.

In the cross-section of the fixing device 300 as illustrated in FIG. 2A, the monitor thermistor TH2 is disposed so as to face the fixing belt 310. The monitor thermistor may be disposed in the loop of the fixing belt 310 or behind the back side of the heater. The controller may use a suitable estimation model to estimate the abnormal temperature rise. Alternatively, the monitor thermistor TH2 may be disposed opposite the pressure roller 320 to detect the excessive temperature rise.

In particular, the thermistor disposed opposite the surface of the pressure roller 320 may be an inexpensive sensor having low heat resistance. A sensor to control the heater may also be disposed behind the heater or may be disposed to face the surface of the fixing belt 310 or inside the loop of the fixing belt 310.

A stay 350 and a heater holder 340 are disposed inside the loop of the fixing belt 310 and extend in the axial direction of the fixing belt 310. The stay 350 is made of a metal channel member, and both side plates of the fixing device 300 support both end portions of the stay 350. The stay 350 reliably receives the pressing force of the pressure roller 320 to stably form a fixing nip SN as the nip.

The sheet P is conveyed to the fixing nip SN in a direction perpendicular to a longitudinal direction of the fixing belt 310 or the longitudinal direction of the heater 330 (or a longitudinal direction of the pressure roller 320). The direction perpendicular to the longitudinal direction does not have to be at an angle of exactly 90° to the longitudinal direction. A direction forming an angle of about 90° with respect to the longitudinal direction is also included in the direction perpendicular to the longitudinal direction. The angle of about 90° is preferably 80° to 100° and more preferably 85° to 95°.

The heater holder 340 holds a substrate 341 of the heating device and is supported by the stay 350. Preferably, the heater holder 340 is made of heat-resistant resin having low heat conductivity, such as a liquid crystal polymer (LCP). Such a configuration reduces heat transfer to the heater holder 340 and effectively heats the fixing belt 310.

The heater holder 340 has a shape that supports two portions of the substrate 341 near both end portions in a short side direction of the substrate 341 to avoid contact with a high-temperature portion of the substrate 341. Thus, the amount of heat flowing to the heater holder 340 can be further reduced to effectively heat the fixing belt 310.

The heating device includes the resistor 370 as a secured member configured by a resistive heat generator. The resistor 370 may be made of a plurality of types as illustrated in FIGS. 3A to 3F.

In either type, the resistor 370 is formed on the substrate 341. The substrate 341 is an elongated thin metal plate coated with an insulating material. The resistor 370 directly heats the fixing nip, which reduces the viscosity of the lubricant in the fixing nip and prevents oil film shortage and the wear of the fixing belt 310.

As the material of the substrate 341, low-cost aluminum, stainless steel, or the like is preferable. However, the material of the substrate 341 is not limited to metal and alternatively may be a ceramic, such as alumina or aluminum nitride, or a nonmetallic material having excellent thermal resistance and insulating properties, such as glass or mica.

To improve thermal uniformity of the heating device and image quality, the substrate 341 may be made of a material having high thermal conductivity, such as copper, graphite, or graphene. The substrate 341 according to the present embodiment uses an alumina base having a lateral width of 8 mm, a longitudinal width of 270 mm, and a thickness of 1.0 mm.

(Single Type Resistor)

Figure 3A:
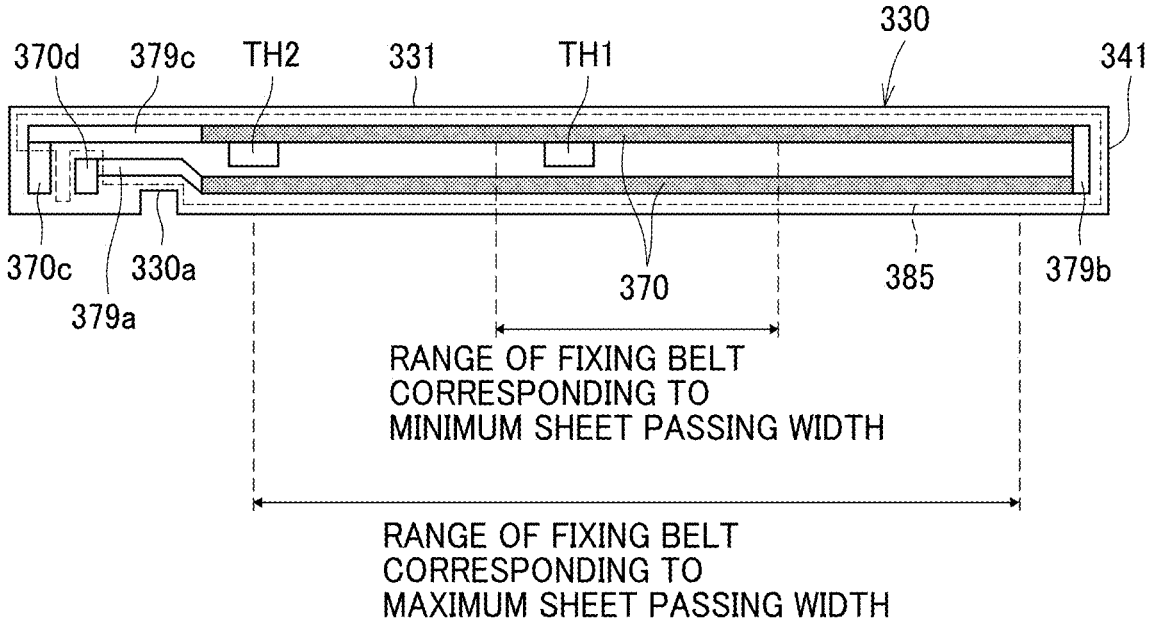
FIG. 3A is a plan view of a heater including electrodes at one end of the heater and a single type resistive heat generator.
Figure 4:
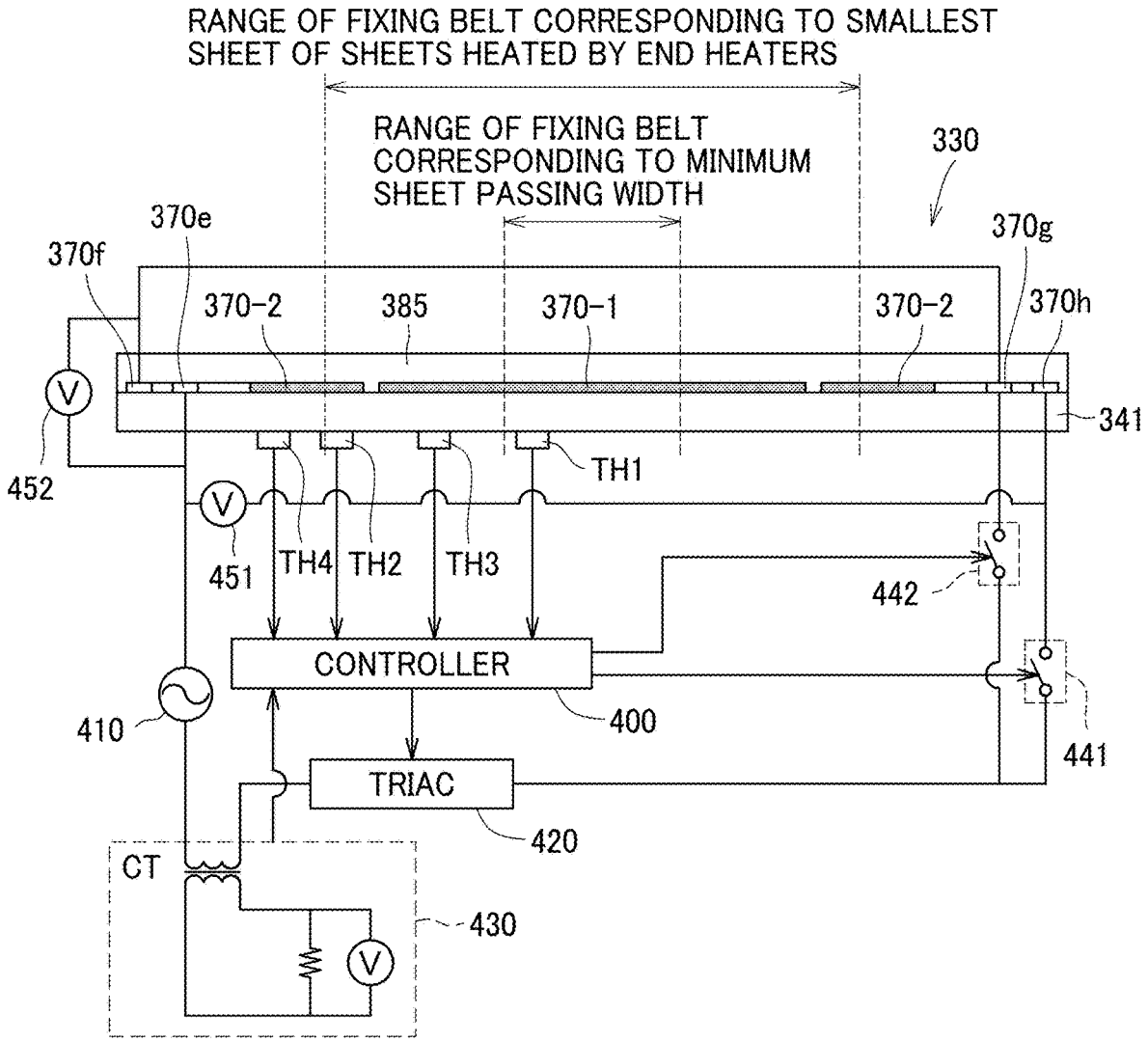
FIG. 4 is a schematic diagram illustrating a circuit including a controller and supplying power to a heating device.

FIG. 3A is a plan view of the heater 330 including a single type resistor 370. The resistor 370 is formed by two parallel rows of resistors in the longitudinal direction of the substrate 341. Ends of the two rows of resistors of the resistor 370 are connected to power supply electrodes 370*c* and 370*d* via power supply lines 379*a* and 379*c* having a small resistance value, being formed on one end of the substrate 341, and extending in the longitudinal direction of the substrate 341. The electrodes 370*c* and 370*d* are connected to a power supply including an alternating-current power supply 410 as illustrated in FIG. 4.

The other ends of the two parallel rows of the resistors of the resistor 370 on the other end of the substrate 341 are connected each other by a power supply line 379*b* having a small resistance value, being on the other end of the substrate 341, and extending in the short side direction of the substrate 341. As a result, the resistor 370 has a form turned back in the longitudinal direction of the substrate 341. The resistor 370, the electrodes 370*c* and 370*d*, and the power supply lines 379*a* to 379*c* are formed by screen-printing with a predetermined line width and thickness.

The resistor 370 can be formed by, for example, applying a paste prepared by mixing silver (Ag), silver-palladium (AgPd), glass powder, or the like to the substrate 341 by screen 1, printing or the like, and then firing the substrate 341. The resistance value of the resistor 370 may be, for example, 10Ω at ordinary temperature. In addition to the above-described materials, a silver alloy (AgPt), ruthenium oxide ($RuO_2$), or the like may also be used as a resistance material of the resistor 370.

The surfaces of the resistor 370 and the power supply lines 379*a* to 379*c* are covered with a thin overcoat layer or an insulation layer 385. The insulation layer 385 secures the slidability with the fixing belt 310 and the insulation between the fixing belt 310 and the resistor 370 and the power supply lines 379*a* to 379*c*. The insulation layer 385 made of heat-resistant glass (heater glass) prevents the lubricant of the fixing belt 310 from impregnating into the resistor 370 serving as the secured member, and thus prevents oil film shortage at the nip surface.

The insulation layer 385 may be, for example, a heat-resistant glass having a thickness of 75 μm. The resistor 370 transfers heat to the fixing belt 310 that contacts the insulation layer 385, raise the temperature of the fixing belt 310, and heats the unfixed toner image on the sheet P conveyed to the fixing nip SN to fix the toner image on the sheet P.

A thermistor TH1 as a first temperature detector is disposed opposite a range of the fixing belt 310 corresponding to the minimum sheet passing width. The thermistor TH1 can accurately detect the temperature of an area of the fixing belt 310 that is in contact with the sheet having any size. Based on the temperature T1 detected by the thermistor T1, the controller controls power supplied to the resistor 370.

The thermistor TH2 for monitoring as a second temperature detector is disposed opposite a part of the fixing belt 310 outside a range of the fixing belt 310 corresponding to the maximum sheet passing width. The thermistor TH2 has a function of monitoring temperature unevenness of the fixing belt 310.

Then, based on a differential temperature (=T1−T2) that is a difference between the temperature T1 detected by the thermistor TH1 and a temperature T2 of the fixing belt 310 detected by the thermistor TH2, the controller performs the temperature difference reduction process that reduces the temperature difference of the fixing belt 310 in the longitudinal direction of the fixing belt 310. In addition, the thermistor TH2 detects the excessive temperature rise of the non-sheet passing portion. The thermistors TH1 and TH2 may be contact type thermistors having a thermal time constant of less than one second. As illustrated in FIGS. 2A to 2D, the thermistors TH1 and TH2 are disposed so that a spring 387 presses each of the thermistors TH1 and TH2 against the back side of the substrate 341.

(Dual Type Resistor)

Figure 3B:
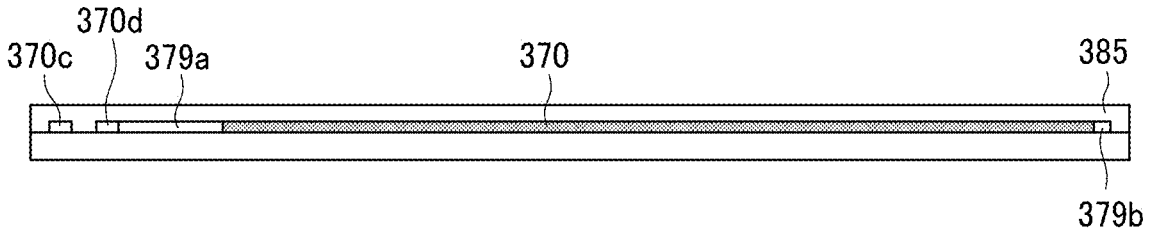
FIG. 3B is a sectional view of the heater including electrodes at the one end of the heater and the single type resistive heat generator.
Figure 3C:
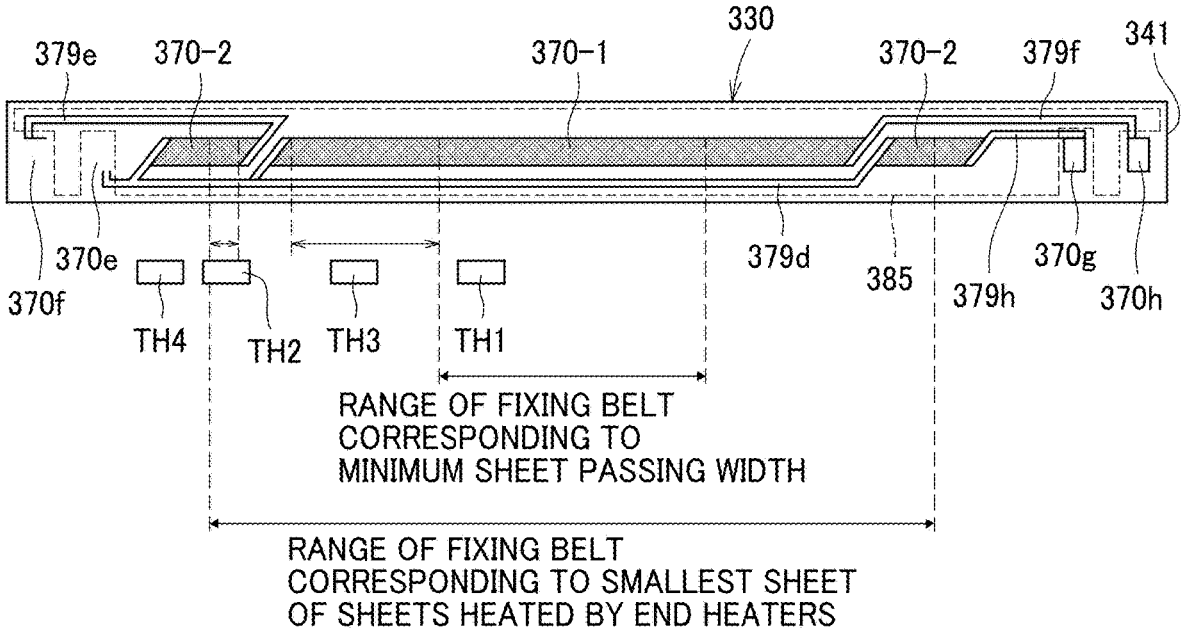
FIG. 3C is a plan view of a heater including electrodes at both ends of the heater and a dual type resistive heat generator.

FIG. 3C is a plan view of the heater 330 including a dual type resistor. The dual type resistor includes a central resistor 370-1 at the center in the longitudinal direction of the heater 330 and a pair of left and right end resistors 370-2 disposed on both sides of the central resistor 370-1. A shape of each of the central resistor 370-1 and the end resistors 370-2 is a parallelogram A side of the central resistor 370-1 and a side of the end resistor 370-2 that face each other are inclined with respect to the short side direction of the substrate 341. The inclined sides reduce a gap between the central resistor 370-1 and each of the end resistors 370-2 when viewed from the short side direction of the substrate 341 and decrease a temperature drop in the gap between the central resistor 370-1 and each of the end resistors 370-2.

The length of the central resistor 370-1 in the longitudinal direction of the heater 330 is 215 mm corresponding to the A4 size of the sheet. The sum of the length of the central resistor 370-1 and the lengths of the end resistors 370-2 in the longitudinal direction is 301 mm corresponding to the A3 size of the sheet. The above-described configuration can prevent the excessive temperature rise when the sheet having A4 size passes through the fixing device because the controller can stop supplying the power to the end resistors 370-2. As a result, the above-described configuration can improve productivity.

As illustrated in FIG. 3C, one end of the central resistor 370-1 is coupled to the left electrode 370*e* via the power supply line 379*d*, and the other end of the central resistor 370-1 is coupled to the right electrode 370*h* via the power supply line 379*f*. In addition, one end of the left end resistor 370-2 is coupled to the left electrode 370*e* via the power supply line 379*d*, and the other end of the left end resistor 370-2 is coupled to the left electrode 370*f* via the power supply line 379*e*. One end of the right end resistor 370-2 is coupled to the left electrode 370*e* via the power supply line 379*d*, and the other end of the right end resistor 370-2 is coupled to the right electrode 370*g* via the power supply line 379*h*.

The central resistor 370-1 can generate heat independently of the end resistors 370-2. Applying a voltage to the electrodes 370*e* and 370*h* causes the central resistor 370-1 to generate heat. Similarly, applying a voltage to the electrodes 370*e* and 370*f* causes the left end resistor 370-2 to generate heat. Applying a voltage to the electrodes 370*e* and 370*g* causes the right end resistor 370-2 to generate heat.

Coupling the electrodes 370*f* and 370*g* in parallel outside the heater enables the left and right end resistors 370-2 to simultaneously generate heat. When the fixing device is configured to convey the sheet on the center of the fixing belt, the temperature distribution of the fixing belt is symmetrical. Therefore, a thermistor may be disposed opposite one of the end resistors 370-2 without disposing two thermistors opposite end resistors 370-2 at both end portions of the substrate 341, thereby reducing the cost.

The central resistor 370-1 and the end resistors 370-2 are covered with the thin insulation layer 385, similar to the above-described single type resistor 370 (illustrated in FIG. 3B) that includes resistors coupling in serial. The insulation layer 385 may be, for example, a heat-resistant glass having a thickness of 75 μm. The insulation layer 385 insulates and protects the central resistor 370-1, end resistors 370-2, and the power supply lines 379*d*, 379*e*, 379*f*, and 379*h* and secures the slidability with the fixing belt 310.

The thermistor TH1 as the temperature detector is disposed opposite the range of the fixing belt 310 corresponding to the minimum sheet passing width. Based on the temperature T1 detected by the thermistor TH1, the controller controls power supplied to the central resistor 370-1. Here, the temperature detection sensor (member) and the temperature control sensor (member) may be provided separately.

As illustrated in FIG. 3C, the thermistor TH3 as the temperature detector is disposed opposite a part of the fixing belt 310 that is outside a range of the fixing belt 310 corresponding to the minimum sheet passing width and does not overlap the inclined side of the central resistor 370-1 in the short side direction of the heater 330. Then, based on a differential temperature (=T1−T3) that is a difference between the temperature T1 detected by the thermistor TH1 and a temperature T3 of the fixing belt 310 detected by the thermistor TH3, the controller performs the temperature difference reduction process that reduces the temperature difference of the fixing belt 310 in the longitudinal direction of the fixing belt 310.

The thermistor TH3 is disposed opposite the above-described part of the fixing belt 310 to detect the excessive temperature rise in the non-sheet-passing portion when the sheet having a size smaller than the length of the central resistor 370-1 in the longitudinal direction of the heater 330 passes through the fixing device. Since a part of the central resistor 370-1 near the inclined side of the central resistor 370-1 has a low heat generation density, the thermistor TH3 is disposed so as not to overlap an inclined portion of the central resistor 370-1 that is a portion of the central resistor 370-1 near the inclined side.

The thermistor TH3 may be disposed opposite a part of the fixing belt 310 that is outside a range of the fixing belt 310 corresponding to the largest sheet of the sheets smaller than the length of the central resistor 370-1 in the longitudinal direction of the heater 330 and does not overlap the inclined side of the central resistor 370-1 in the short side direction of the heater 330 to detect the excessive temperature rise when the sheets other than the minimum sheet pass through the fixing device. The thermistor TH3 may not be disposed inside the loop of the fixing belt 310 and may measure temperatures of the outer circumferential surface of the pressure roller 320.

Since the temperature of the pressure roller 320 that is in contact with the fixing belt 310 and has a large thermal capacity is lower than the temperature of the fixing belt 310 including the heater, the thermistor TH3 may be an inexpensive thermistor. In addition, the thermistor is coupled to lead wires described below. A space to set the lead wires is designed to set the thermistor disposed near the heater inside the loop of the fixing belt 310. When the number of thermistors increases, the number of lead wires also increases, and thus the diameter of the fixing belt increases. Measuring the temperature of the pressure roller 320 in contact with the fixing belt 310 can reduce the number of lead wires inside the loop of the fixing belt 310.

As illustrated in FIG. 3C, the thermistor TH2 as the temperature detector is disposed opposite a part of the fixing belt 310 corresponding to an end of the smallest sheet of sheets heated by the end resistors 370-2. Based on the temperature T2 detected by the thermistor TH2, the controller controls power supplied to the end resistors 370-2.

As illustrated in FIG. 3C, the thermistor TH4 is disposed opposite a part of the fixing belt 310 that is outside a range of the fixing belt 310 corresponding to the maximum sheet passing width and faces one of the end resistors 370-2 but does not overlap the inclined side of the one of the end resistors 370-2 in the short side direction of the heater 330. Then, based on a differential temperature (=T2−T4) that is a difference between the temperature T2 detected by the thermistor TH2 and a temperature T4 of the fixing belt 310 detected by the thermistor TH4, the controller performs the temperature difference reduction process that reduces the temperature difference of the fixing belt 310 in the longitudinal direction of the fixing belt 310. The thermistors TH1 to TH4 may be the contact type thermistors having the thermal time constant of less than one second. As illustrated in FIGS. 2A to 2D, the thermistors TH1 and TH2 are disposed so that a spring 387 presses each of the thermistors TH1 and TH2 against the back side of the substrate 341.

As described above, using the thermistor for monitoring the temperature evenness, such as the thermistor TH2 in FIG. 3A or the thermistors TH3 and TH4 in FIG. 3C, in addition to the thermistor for controlling the heater in the fixing device, such as the thermistor TH1 in FIG. 3A or the thermistors TH1 and TH2 in FIG. 3C enables reducing the temperature unevenness when the toner image is fixed onto the sheet. Thus, the above-described configuration enables both of a quick start of fixing operations and prevention of uneven gloss of the toner image. In addition, the heater 330 that is the planar heater having heat generation patterns (that are the resistors) as the heat source separated and independently controlled as illustrated in FIG. 3C prevents the occurrence of uneven gloss of the toner image on the sheets having different sizes and improves productivity.

Even when the toner has a high temperature dependency of glossiness, the above-described configuration can prevent the occurrence of uneven gloss of the formed toner image. As illustrated in FIG. 3C, the thermistors always monitor the temperature difference of the fixing belt between the center portion above the resistor 370-1 and the end portion above the resistor 370-1, the temperature difference of the fixing belt between the center portion above the resistor 370-2 and the end portion above the resistor 370-2, and the temperature difference of the fixing belt between the portion above the resistor 370-1 and the portion above the resistor 370-2. The controller determines whether these differences are within a certain range and controls sheet feeding operations. Accordingly, the above-described configuration can prevent the occurrence of uneven gloss.

FIG. 3B illustrates the embodiment of the heater including three blocks of resistors arranged symmetrically with respect to the center of the sheet passing through the fixing device. The present embodiment is not limited to this. The heater may include more blocks of resistors such as five blocks or seven blocks. Similar to the above-described embodiment, a plurality of thermistors disposed above each resistor can provide a system that prevents the occurrence of uneven gloss, (Multi-Type Resistor)

Figure 3D:
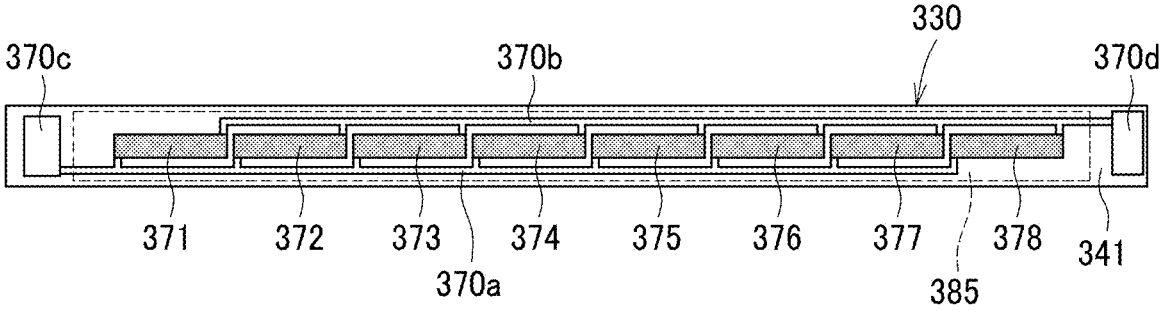
FIGS. 3D to 3F are plan views of heaters each including electrodes at both ends of the heater and a multi-type resistive heat generator.
Figure 3E:
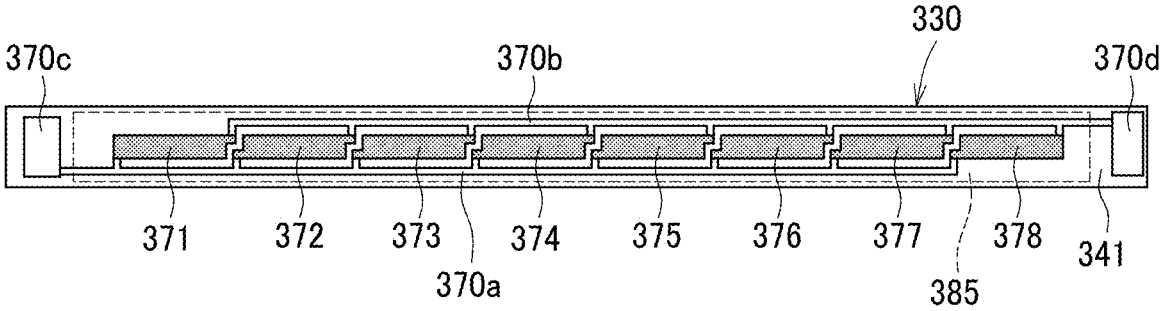
Figure 3F:
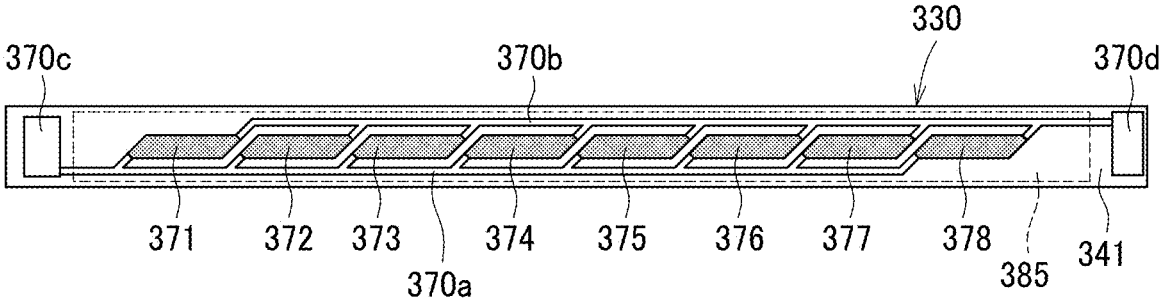

The resistor 370 may be configured as a multi-type resistor including positive temperature coefficient (PTC) elements 371 to 378 electrically coupled in parallel as illustrated in FIGS. 3D to 3F.

Also, in the multi-type resistor, the thermistors may be arranged similar to the thermistors TH1 and TH2 in FIG. 3A or the thermistors TH1 to TH4 in FIG. 3C. When the resistance value between electrodes 370*c* and 370*d* at both ends of FIGS. 3D to 3F is assumed to be 10Ω, the resistance value of each of the PTC elements 371 to 378 is increased to 80Ω due to the parallel connection.

The PTC element is made of a material having a positive temperature resistance coefficient and has a characteristic that the resistance value increases as the temperature T increases (the current I decreases, and the heater output decreases). The temperature coefficient of resistance (TCR) may be, for example, 1500 parts per million (PPM). The temperature coefficient of resistance may be stored in a memory of the controller 400 (see FIG. 4) described below.

The PTC elements 371 to 378 illustrated in FIGS. 3D to 3F are arranged linearly at equal intervals in the longitudinal direction of the substrate 341. On both sides of each of the PTC elements 371 to 378 in the short-side direction of the substrate 341, power supply lines 370*a* and 370*b* having small resistance values are linearly arranged in parallel to each other. Both ends of each of the PTC elements 371 to 378 are coupled to the power supply lines 370*a* and 370*b*. As illustrated in FIG. 4, a power supply unit including an AC power supply 410 is coupled to the electrodes 370*c* and 370*d* formed at one ends of the power supply lines 370*a* and 370*b*.

Similar to the above-described single type resistor 370 (illustrated in FIG. 3A) that includes resistors coupling in serial, the PTC elements 371 to 378 and the power supply lines 370*a* and 370*b* are covered with a thin insulation layer 385. The insulation layer 385 may be, for example, a heat-resistant glass having a thickness of 75 μm. The insulation layer 385 insulates and protects the PTC elements 371 to 378 and the power supply lines 370*a* and 370*b* and maintains the slidability with the fixing belt 310.

The PTC elements 371 to 378 may be formed by, for example, applying the paste prepared by mixing silver-palladium (AgPd), glass powder, or the like to the substrate 341 by screen printing or the like, and then firing the substrate 341. In the present embodiment, the resistance value of each of the PTC elements 371 to 378 is set to 80Ω at ordinary temperature (the total resistance value is set to 10Ω).

As the material of the PTC elements 371 to 378, a resistance material such as the silver alloy (AgPt) or ruthenium oxide (RuO2) may be used in addition to the materials described above. Silver (Ag), silver palladium (AgPd) or the like may be used as a material of the power supply lines 370*a* and 370*b* and the electrodes 370*c* and 370*d*. In such a case, screen-printing such a material forms the power supply lines 370*a* and 370*b* and the electrodes 370*c* and 367*d*.

The PTC elements 371 to 378 transfer heat to the fixing belt 310 that contacts the insulation layer 385, raise the temperature of the fixing belt 310, and heats an unfixed toner image on the sheet P conveyed to the fixing nip SN to fix the toner image on the sheet P.

Use of the PTC elements 371 to 378 reduces an increase in temperature in the PTC element in which small sheets do not contact when the small sheets pass through the fixing device 300 since the relation of the PTC element (that is a resistance heating element) between resistance and temperature reduces heat generation amount in the PTC element in which the small sheets do not contact. For example, printing sheets smaller than a width corresponding to all PTC elements 371 to 378, for example, sheets having width corresponding to the PTC elements 373 to 376, raises temperatures in the PTC elements 371, 372, 377, and 378 disposed outside the sheets because the sheets do not draw heat from the PTC elements 371, 372, 377, and 378. Raising temperatures in the PTC elements 371, 372, 377, and 378 causes increase in resistance values of the PTC elements 371, 372, 377, and 378.

Since a constant voltage is applied to the PTC elements 371 to 378, the increase in resistance values relatively reduces outputs of the PTC elements 371, 372, 377, and 378 disposed outside the width of the sheet, thus restraining an increase in temperature in end portions outside the sheets. If the PTC elements 371 to 378 are electrically coupled in series, to prevent the resistance heat generator outside the width of the sheets from raising temperature in continuous printing, there is no method except a method of reducing a print speed. Electrically coupling the PTC elements 371 to 378 in parallel can restrain temperature rises in non-sheet passage portions while maintaining the print speed.

As the temperature increases, the strength of the fixing belt 310 decreases. Therefore, the fixing belt 310 is likely to be worn. Using the multi-type resistor as the resistor 370 can prevent the excessive temperature rise in the non-sheet-passing portion even when small sheets pass through the fixing device, thereby preventing wear of the fixing belt 310 and also obtaining an effect of preventing evaporation of the lubricant.

An arrangement of the PTC elements 371 to 378 is not limited to the arrangement illustrated in FIG. 3D. In FIG. 3D, since gaps extending in the short side direction between the PTC elements 371 to 378 do not generate heat, temperature decrease may occur in the gaps, which may cause uneven fixing. In contrast, ends of the PTC elements 371 to 378 in the longitudinal direction overlap as illustrated in FIGS. 3E and 3F.

In FIG. 3E, a step portion formed by an L-shaped notch is formed an end portion of each of the PTC elements 371 to 378, and the step portion overlaps with a step portion at an end portion of the adjacent PTC element. In FIG. 3F, an oblique cut-away inclination is formed at each of the end portions of the PTC elements 371 to 378 so that the inclination overlaps the inclination of the end portion of the adjacent PTC element. Mutually overlapping the end portions of the PTC elements 371 to 378 in this manner can restrain the influence of a decrease in heat generating amount in gaps between the PTC elements.

The electrodes 370*c* and 370*d* may be disposed on one side of the PTC elements 371 to 378 as illustrated in FIGS. 3D to 3F instead of being disposed on both sides of the PTC elements 371 to 378. Disposing the electrodes 370*c* and 370*d* on one side of the PTC elements 371 to 378 in this manner reduces the size of the fixing device in the longitudinal direction, which results in space saving.

Each of the PTC elements 371 to 378 in FIGS. 3D to 3F is made of a strip-shaped planar heat generating element. In some embodiments, for example, a plurality of PTC elements having a meandering shape with a reduced line width may be electrically connected in parallel in order to obtain a desired output (resistance value).

(Power Supply Circuit)

FIG. 4 illustrates a power supply circuit to supply power to the heater. This power supply circuit is generally disposed in the main body of the image forming apparatus 100.

In FIG. 4, the resistor 370 of the heater includes the central resistor 370-1 and the end resistors 370-2 illustrated in FIG. 3C. FIG. 4 illustrates the power supply circuit for supplying power to the central resistor 370-1 and the end resistors 370-2 under the heater 330.

The power supply circuit as a power controller includes a controller 400, an AC power supply 410, a triac 420, a current detector 430, heater relays 441 and 442, and voltage detectors 451 and 452. The controller 400 and the triac 420 are configured as a power supply device.

The AC power supply 410, a current transformer CT in the current detector 430, the triac 420, and the heater relays 441 and 442 are coupled in series between the electrode 370*e* on one end of the substrate 341 and the electrodes 370*g* and 370*h* on the other end of the substrate 341. In addition, the voltage detector 452 is coupled between the electrodes 370*e* and 370*f* on the one end of the substrate 341, and the voltage detector 451 is coupled between the electrode 370*e* on the one end of the substrate 341 and the electrode 370*h* on the other end of the substrate 341.

The temperatures detected by the thermistors TH1 to TH4 are input to the controller 400. Based on the temperatures detected by the thermistors TH1 and TH2, the controller 400 determines a duty cycle of a current flowing from the electrodes 370*g* and 370*h* to the electrode 370*e* so that each of the temperatures of parts of the fixing belt heated by the central resistor 370-1 and the end resistor 370-2 is within a predetermined target temperature range and controls the triac 42) to perform duty control.

Specifically, the triac 420 performs the duty control of the current flowing through the central resistor 370-1 at the duty cycle corresponding to the temperature difference between the current temperature detected by the thermistor TH1 and a target temperature. The current is zero at a 0% duty cycle and is a maximum value at a 100% duty cycle.

Similarly, the triac 420 performs duty control of the current flowing through the end resistors 370-2 at the duty cycle corresponding to the temperature difference between the current temperature detected by the thermistor TH2 and the target temperature. Here, the "duty" is a ratio of an energization time to the resistor 370 per control cycle.

On the other hand, the controller 400 performs the temperature difference reduction process that reduces the temperature difference of a part of the fixing belt 310 heated by the central resistor 370-1 by using the above-described method based on the differential temperature between the current temperature detected by the thermistor TH1 and the current temperature detected by the thermistor TH3. Similarly, the controller 400 performs the temperature difference reduction process that reduces the temperature difference of a part of the fixing belt 310 heated by the right and left end resistors 370-2 based on the differential temperature between the current temperature detected by the thermistor TH2 and the current temperature detected by the thermistor TH4.

The controller 400 may be a microcomputer including a central processing unit (CPU), a read-only memory (ROM), a random-access memory (RAM), and an input and output (1/O) interface. The sheet passing through the fixing nip SN takes heat, that is, causes heat transfer to the sheet. Therefore, control of the current supplied to the electrodes based on the heat transfer in addition to the temperature T1 detected by the thermistor TH1 can control the temperature of the fixing belt 310 to a desired temperature.

The current detector 430 detects a total current value flowing through the resistor 370. That is, the controller 400 reads the current value I flowing between the electrode 370*e* on one end of the substrate 341 and the electrodes 370*g* and 370*h* on the other end of the substrate 341 based on a voltage generated in a secondary side resistance of the current transformer CT.

The voltage detector 451 detects a voltage E between the electrode 370*e* of the resistor 370 on one end of the substrate 341 and the electrodes 370*g* and 370*h* of the resistor 370 on the other end of the substrate 341, and the controller 400 reads the detected voltage E. The controller 400 calculates a resistance value R (=E/I) of the resistor 370 from the current value I and the voltage value E.

In FIG. 2A, when the sheet P is conveyed in a direction indicated by arrow and passes through the fixing nip SN, the sheet P is heated between the fixing belt 310 and the pressure roller 320 so that the toner image is fixed to the sheet P. In this case, heat from the resistor 370 heats the fixing belt 310 sliding on the insulation layer 385 covering the resistor 370.

(Other Embodiments of Fixing Device)

Figure 2B:
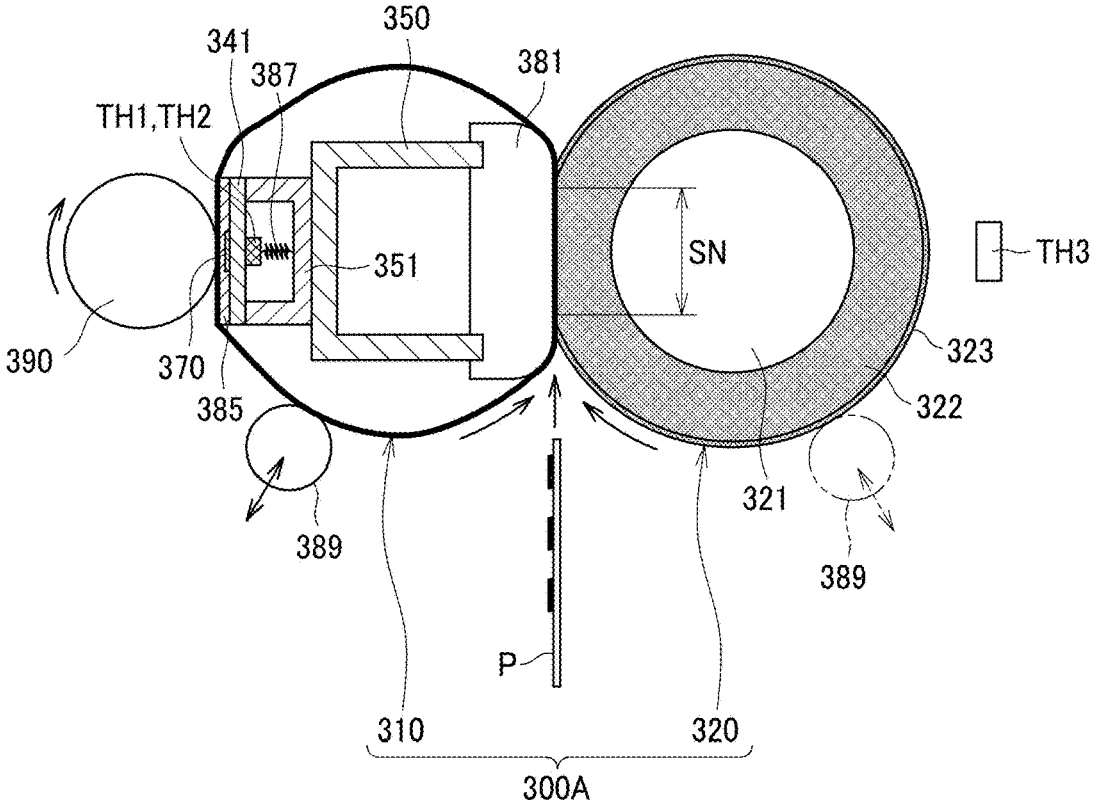
FIG. 2B is a cross-sectional view of a fixing device according to an embodiment of the present disclosure.
Figure 2C:
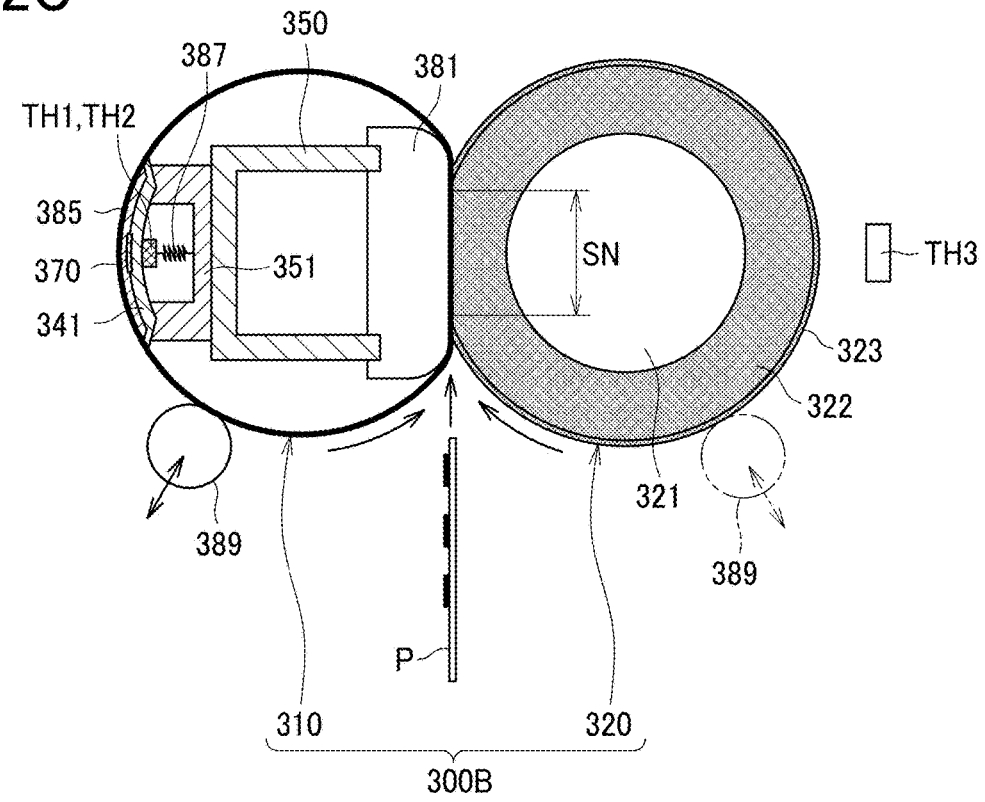
FIG. 2C is a cross-sectional view of a fixing device according to an embodiment of the present disclosure.
Figure 2D:
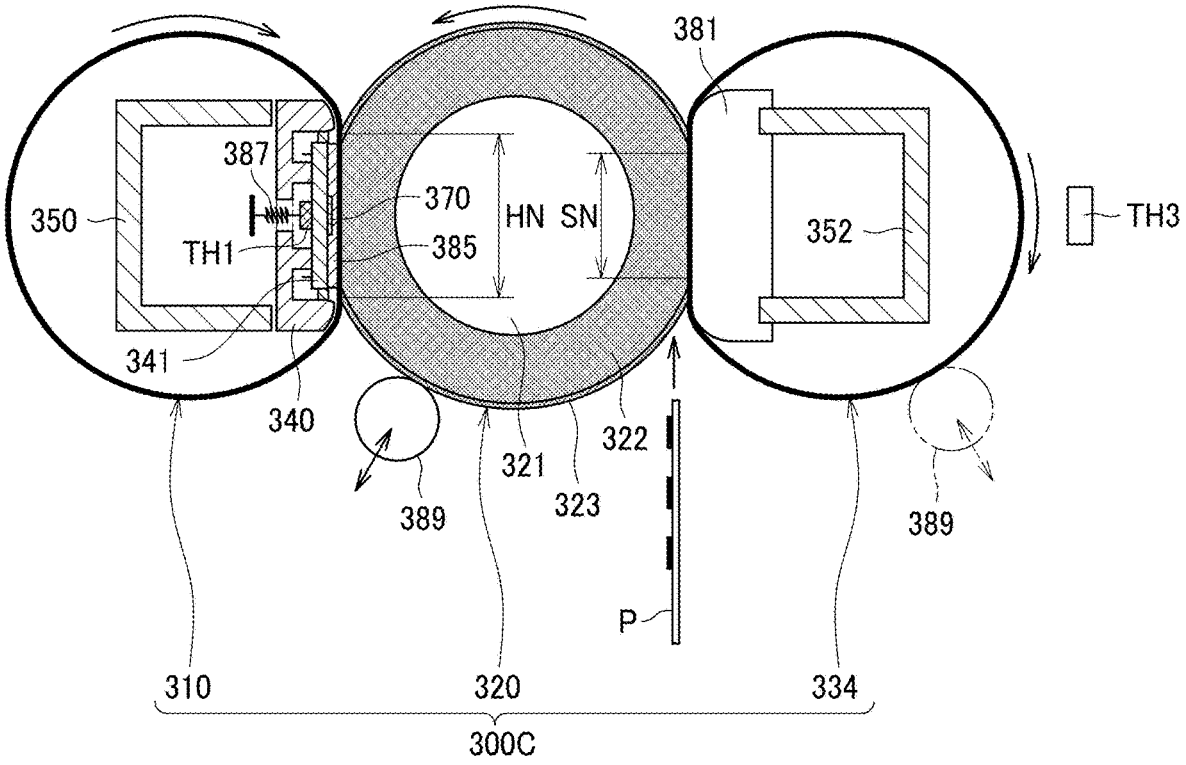
FIG. 2D is a cross-sectional view of a fixing device according to an embodiment of the present disclosure.

The fixing device according to an embodiment of the present disclosure is not limited to the fixing device 300 in FIG. 2A. With reference to FIGS. 2B to 2D, the fixing devices 300A, 300B, and 300C according to other embodiments of the present disclosure are described below. As illustrated in FIG. 2B, the fixing device 300A includes a pressing roller 390 on the opposite side of the pressure roller 320 and nips the fixing belt 310 between the pressing roller 390 and the heating device to heat the fixing belt 310.

The heating device described above is disposed inside the loop of the fixing belt 310. An auxiliary stay 351 is attached on one side of a stay 350, and a nip formation pad 381 is attached on the other side of the stay 350.

The auxiliary stay 351 supports the heating device. The nip formation pad 381 contacts the pressure roller 320 via the fixing belt 310 to form the fixing nip SN.

As illustrated in FIG. 2C, the fixing device 300B includes the heating device disposed inside the loop of the fixing belt 310. Instead of the pressing roller 390 described above, the heating device includes the substrate 341 and the insulation layer 385 both of which have arc-shaped cross sections meeting the curvature of the fixing belt 310 to lengthen a circumferentially contact length of the fixing belt 310.

The resistor 370 is disposed at the center of the arc-shaped substrate 341. Other parts of the fixing device 300B are the same as those of the fixing device 300A in FIG. 2B.

As illustrated in FIG. 2D, the fixing device 300 (includes a heating nip HN and the fixing nip SN separately. That is, the fixing belt 310 is disposed at one side of the pressure roller 320, and the nip formation pad 381 and the stay 352 made of a metallic channel member are disposed at the opposite side of the pressure roller 320 opposite to the one side at which the fixing belt 310 is disposed. A pressure belt 334 is disposed enclosing the nip formation pad 381 and the stay 352 so as to be circularly rotatable.

The sheet P passes through the fixing nip SN between the pressure belt 334 and the pressure roller 320 and is subjected to heating and fixing. Other parts of the fixing device 300C are the same as those of the fixing device 300 in FIG. 2A.

(Manufacturing Method of Fixing Belt)

The following describes a method of manufacturing the fixing belt 310 according to the present embodiments. The elastic power of the inner portion having the inner surface (that is the sliding surface) of the fixing belt 310 used in the present embodiments is 55% or more under an environmental condition of a temperature of 23° C. and a relative humidity of 50%. Present inventors made fixing belts as follows.

Firstly, preparation of coating liquid for the fixing belt is described.

To make the coating liquid, a preparation liquid A was prepared by adding N-methyl-pyrrolidone (NMP) 80 g to the polyimide varnish 100 g and mixing.

As the polyimide varnish, U-imide varnish AR® manufactured by UNITIKA LTD. was used.

NMP was N-methyl-pyrrolidinone special grade manufactured by Kanto Chemical Co., Inc.

Needle-shaped inorganic filler was gradually added to the above-described preparation liquid A while performing blade stirring by a desktop mixer, and kneading was performed.

The needle-shaped inorganic filler 20 g was added to the polyimide varnish 100 g.

The needle-like inorganic filler was gradually added and kneaded over about 10 to 15 minutes so as not to form beads.

As the needle-like inorganic filler, TISMO D w manufactured by Otsuka Chemical Co., Ltd. was used. As a result, the coating liquid B was prepared.

The coating liquid B was coated to the inner circumferential surface of the fixing belt as follows. Coating method to coat the coating liquid to the fixing belt is generally spray coating or dipping coating.

Present inventors used the spray coating.

The coating liquid B was put into a pumping tank.

The fixing belt as an object to be coated was rotated in order to coat the coating liquid B to the inner circumferential surface of the fixing belt.

The number of rotations of the fixing belt is set in a range of 900 to 1000 rpm. The present inventors set the number of rotations of the fixing belt to be 900 rpm.

The present inventors set a coating speed to be 30 mm/s. A coating weight in one coating process was set to be in a range of 0.7 to 1.2 g.

The coating weight is adjusted by the pressure at which the coating liquid B is pumped.

The present inventors set the pressure to be 125 kPa, and the coating weight in one coating process was 1.0 g.

After coating, preliminary drying was carried out with hot air at 200° C., and the coating process was repeated.

The coating process and preliminary drying were repeated three to four times. After completion of each coating process, in order to volatilize NMP, the fixing belt was put into a drying furnace at 260° C. and heat-treated for 30 minutes.

The film thickness of the sliding layer was g to 15 μm.

For example, when the coating liquid B 4.2 g was applied, the film thickness was 11 μm.

Subsequently, the fixing belt was fired.

Firing process was carried out in a vertical type far-infrared firing furnace.

The vertical type far-infrared firing furnace included far-infrared heaters laterally disposed and each having a heating range equal to or longer than the fixing belt. The fixing belt was vertically disposed between the far-infrared heaters.

The temperature of the far-infrared heaters was set so that the fixing belt had a predetermined temperature.

When the elastic power was set to be relatively high, firing temperature was set, for example, as follows.

The temperature of the far-infrared heaters was set so that the actual temperature of the fixing belt was 360° C.

Firing time was 30 minutes.

The elastic power of the sliding layer after firing was measured and found to be 70.0% under the condition of ordinary temperature 23° C. and 60.2% under the condition of heating at 165° C.

When the elastic power was set to be relatively lower, firing temperature was set, for example, as follows.

The temperature of the far-infrared heaters was set so that the actual temperature of the fixing belt was 280° C.

Firing time was 30 minutes.

The elastic power of the sliding layer after firing was measured and found to be 60.4% under the condition of ordinary temperature 23° C. and 52.1% under the condition of heating at 165° C.

The surface roughness of the inner circumferential surface of the fixing belt may be adjusted as follows. Changing the size or shape of the filler contained in the coating liquid can control the surface roughness of the inner circumferential surface of the fixing belt. Polishing the inner circumferential surface of the fixing belt can also control the surface roughness of the inner circumferential surface of the fixing belt.

(Abnormal Noise Reduction Effect Due to Belt Surface Roughness)

Decreasing an amount of lubricant on the sliding surface causes abnormal noise on the sliding surface. Increasing the amount of lubricant on the sliding surface prevents occurrence of the abnormal noise.

Increasing the surface roughness of the inner circumferential surface of the fixing belt increases the amount of lubricant held on the inner circumferential surface of the fixing belt. Increasing the amount of lubricant held on the inner circumferential surface of the fixing belt and rotating the fixing belt increases the amount of lubricant newly flowing into the sliding surface, which is advantageous for reducing the abnormal noise.

Figure 9A:
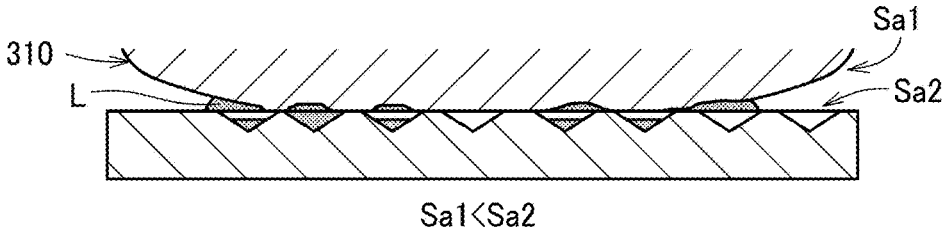
FIGS. 9A and 9B are diagrams each illustrating lubricant held between the fixing belt and one of heaters with different surface roughness.

In addition, the roughness of a slide surface of the heater relates to holding the sufficient amount of lubricant between the sliding surface of the fixing belt and the slide surface of the heater to reduce the abnormal noise. The slide surface of the heater is a surface of the heater on which the fixing belt slides. As illustrated in FIG. 9A, which is described below, setting the roughness Sa2 of the slide surface of the heater larger than the roughness Sa1 of the inner circumferential surface of the fixing belt moves the lubricant held on the inner circumferential surface of the fixing belt to flow into a sliding portion.

However, an amount of the lubricant flowing into the sliding portion as described above is not enough to fill recessed portions of the slide surface of the heater, and an oil film of the lubricant is not formed on protruding portions of slide surface of the heater. As a result, the abnormal noise and the wear of the fixing belt occur. In addition, the inner circumferential surface of the fixing belt sliding on the secured member deteriorates and forms scratches that causes unevenly heating the toner image. As a result, an abnormal image such as the uneven gloss or a gloss streak of the toner image occurs.

As the roughness Sa1 of the inner circumferential surface of the fixing belt increases, the amount of grease held by the fixing belt increases. The present inventors made the fixing belts having different surface roughness of the inner circumferential surfaces and the heaters having different surface roughness and checked whether the abnormal noise occurred in the fixing device as follows. Fluorine grease was applied onto the heater, and the fixing device was driven for 10 minutes. The velocity of the fixing belt was controlled to be 30 mm sec, and the heater was controlled so that the surface temperature of the fixing belt was 200° C. The abnormal noise occurred as follows.

| SURFACE ROUGHNESS OF INNER CIRCUMFERENTIAL SURFACE OF FIXING BELT Sa1 | SURFACE ROUGHNESS OF HEATER Sa2 | OCCURRENCE OF ABNORMAL NOISE |
|---|---|---|
| 0.4 μm | 0.05 μm | NONE |
| 0.2 μm | 0.05 μm | NONE |
| 0.2 μm | 0.2 μm | ABNORMAL NOISE OCCURRED |
| 0.1 μm | 0.05 μm | SLIGHT ABNORMAL NOISE OCCURRED |

The fixing belt as a rotator having the inner circumferential surface as the sliding surface with the roughness Sa1 of 0.2 μm or more stably holds the grease on the inner circumferential surface of the fixing belt. When the surface as the slide surface of the insulation layer of the heater as the secured member and an opposing member has the roughness Sa2 of 0.05 μm or less, the surface is stably covered by the oil film. Note that the surface roughness Sa1 and Sa2 mean a surface roughness Sa in a sliding direction in which the fixing belt slides on the heater, in other words, a rotation direction of the fixing belt.

Setting the surface-roughness Sa2 of the insulation layer of the heater to 0.05 μm or less prevents grease shortage at the protruding portions of the insulation layer of the heater that is caused by the recessed portions of the insulation layer into which the grease conveyed from the fixing bell enters. Setting the surface roughness Sa2 as described above holds the grease from the fixing belt on the slide surface of the heater. It is further desirable that a space volume Vvv of a core portion, which is valley void volume Vvv described below, representing the volume of the recessed portions of the uneven surface is 0.01 ml/m$^2$ or more. Since the space volume Vvv of the core portion represents the volume of the recessed portions of the uneven surface, the larger the space volume Vvv is, the larger the recessed portion is. The large recessed portion in the inner circumferential surface of the fixing belt holds much grease and conveys the much grease to the secured member such as the heater, which prevents the occurrence of the abnormal noise.

The lubricant may include fluorine grease or silicone oil. The lubricant maintains lubricity between members that slide each other at high temperature and high surface pressure for a long time and decreases the wear.

The fixing belt not including the elastic layer made of rubber or the like has a small rigidity and tends to follow the shape of the nip entrance. Then, the grease is easily supplied to the nip due to the capillary phenomenon.

(Method of Measuring Elastic Power)

Figure 5A:
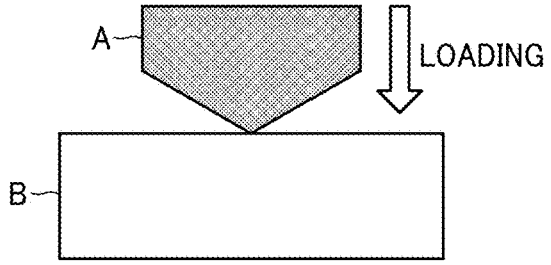
FIGS. 5A to 5D are explanatory diagrams illustrating a method for measuring elastic power.
Figure 5B:
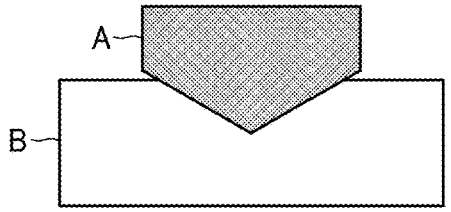
Figure 5C:
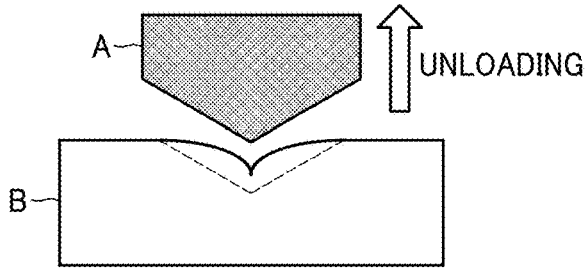

The elastic power described above may be measured by a loading-unloading test (i.e., an indentation test) of a micro surface hardness tester using a diamond indenter, and a material having a measured result closer to 1 (100%) is determined as a material that is more easily elastically deformed. As illustrated in FIG. 5A, a diamond indenter A is in contact with a sample B. As illustrated in FIG. 5B, the diamond indenter A is shoved into the sample B at a constant load speed (that is, a loading process) and stops for a constant time after the diamond indenter A receives a set load and moves to a maximum displacement. Subsequently, as illustrated in FIG. 5C, the diamond indenter A is pulled up at a constant unloading speed (that is, an unloading process). Finally, the diamond indenter A does not receive the load, the elastic deformation of the sample B is restored, and the plastic deformation remains in the sample B.

Figure 5D:
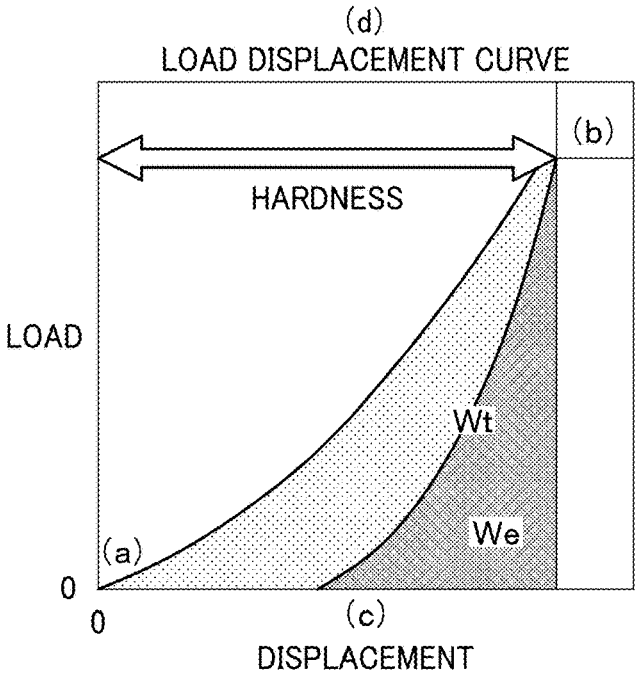

During the above-described processes, relations between load and displacement that is the depth of the sample B into which the diamond indenter A is shoved are recorded as curves illustrated in FIG. 5D. The curves give the elastic power that is the ratio of a work We of elastic deformation to a total work (that is a work Wt of plastic deformation+the work We of elastic deformation) performed on a sample by the diamond indenter A.

The elastic power (%) is expressed by the following expression.

Elastic power (%)=work of elastic deformation *We*×100/(work of plastic deformation *Wt*+work of elastic deformation *We*)

The elastic power measurement is performed at a constant temperature and humidity. The present inventors measured the elastic powers under an environmental condition of a temperature of 23° C. and a relative humidity of 50%. The measurement was performed as follows. A Fischer scope HM-2000 IP (manufactured by Fischer Instruments K.K.) and a Vickers indenter were used. The load was applied under the conditions of a set load 20 mN, a time 30 sec until reaching the maximum load, and a creep time 5 sec. Unloading was performed during 30 sec. However, the measurement may be performed by any device having an equivalent performance.

Samples that were fixing belts were closely attached to a metal board to measure the elastic power. Since the elastic power is affected by the spring characteristics of the board, a rigid metal plate, slide glass, or the like is suitable as the board.

The set load was adjusted so that the maximum displacement was 1/10 of the thickness of the inner portion to decrease influences due to factors of hardness and elasticity of layer adjacent to the inner portion (for example, the base made of metal in the fixing belt). Preferably, the elastic layer and the release layer are removed when the measurement is performed to exclude the influence of the elastic layer and the release layer on the base. The present inventors removed the elastic layer and the release layer from the fixing belt when the measurement was performed.

(Difference Between Elastic Power and Return Rate)

Figure 6:
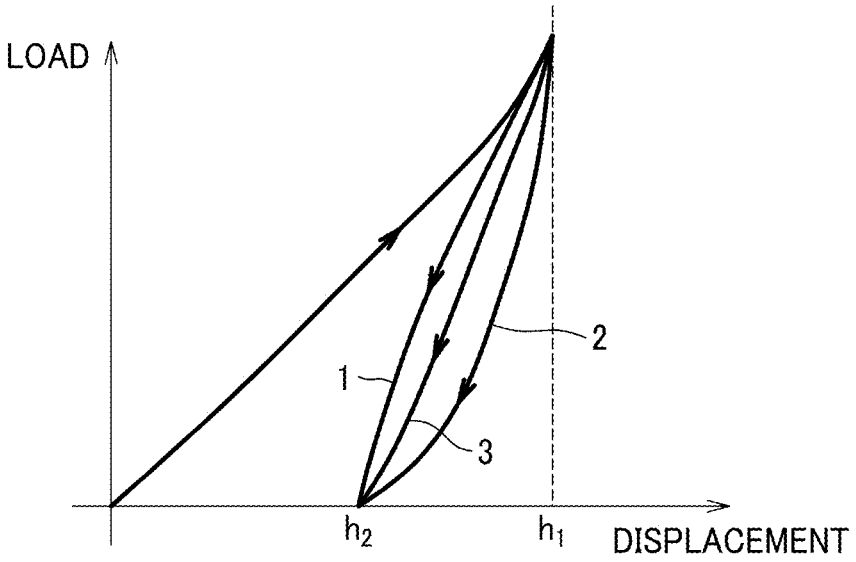
FIG. 6 is a load-displacement diagram illustrating the difference between the elastic power and return rate.

There is a return rate as an index similar to the elastic power. However, the return rates are all the same for return lines 1, 2 and 3, as illustrated in the load-displacement diagram of FIG. 6. In contrast, the elastic powers in all of the return lines 1, 2, and 3 are different values because the elastic power includes information on the change of load during deformation, in other words, information on the area of the graph illustrated in FIG. 5.

The elastic power is represented by the area of the displacement-load curve during loading and the area of the displacement-load curve during unloading that each mean an energy loss. As the difference between these areas are larger, a frictional force (in other words, a torque to rotate the fixing belt) increases. For example, the present inventors found that different frictional forces occur when the fixing belts having the same return rate but having different profiles during unloading in the graph as illustrated in FIG. 5D rotate.

Accordingly, the elastic power is more effective as the characteristics of the sliding surface because the elastic power includes information on the frictional force in addition to the wear resistance. Since the return rate does not include the information on the area as illustrated in FIG. 5D, the return rate does not give the information regarding the frictional force.

(Difference of Wear Due to Elastic Power)

Figure 7:
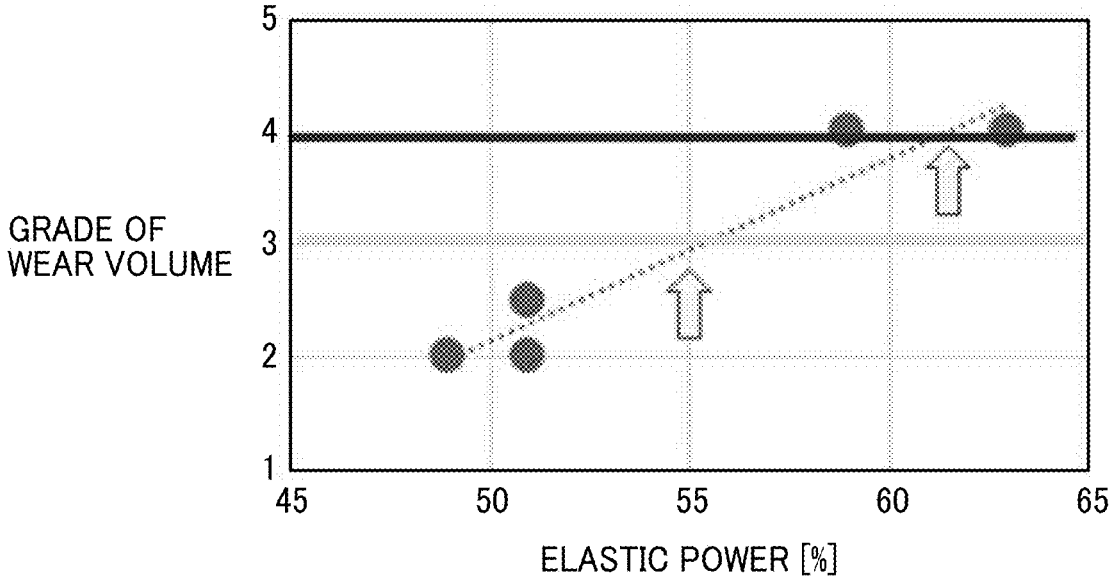
FIG. 7 is a graph illustrating a relation between grades of inner surface wear volumes of fixing belts and the elastic powers of the bases of the fixing belts.

The present inventors performed tests each evaluating the wear of fixing belt and found that the wear resistance of the fixing belt was improved by increasing the elastic power of the base of the fixing belt, in other words, an inner portion having the sliding surface that slides on the secured member such as the heater as illustrated in FIG. 7. The elastic power may be measured by the indentation test described above with reference to FIGS. 5A to 5D, and the material having the measured result closer to 1 (100%) is determined as the material that is more easily elastically deformed.

The lubricant on the inner circumferential surface of the fixing belt enters the slide surface of the secured member, but an amount of the lubricant that can enter the slide surface changes in accordance with a nip pressure. The larger the nip pressure is, the smaller the amount of the lubricant entering the slide surface is. In particular, the amount of a soft lubricant having a high consistency and entering the slide surface is smaller than the amount of a hard lubricant having a low consistency and entering the slide surface.

In other words, using the hard lubricant with a low consistency (in other words, having a high viscosity) increases the amount of the lubricant entering the slide surface to be more than the amount of the soft lubricant entering the slide surface and reduces the wear due to sliding. The large elastic power of the inner portion of the fixing belt and a reaction force generated by the lubricant having the low consistency and the high viscosity is likely to generate a gap between the inner circumferential surface of the fixing belt and the secured member, which gives an effect of allowing a larger amount of the lubricant to easily enter the slide surface. As a result, the wear resistance is improved.

The present inventors made the following configuration for the tests. The fixing belt had the inner portion made of PI-based paint. The inner portion slid on the glass surface 30' of the planar heater as a nip formation pad. The pressure roller was configured to press the fixing belt against the planar heater.

Fluorine-based grease having the consistency of 275 was used as the lubricant.

In the test, the fixing belt was repeatedly heated so as to be the belt temperature of 180° C. and rotated for a time that is a life of the fixing belt in the image forming apparatus. Martens hardness was measured under the indentation of 1 μm. The hardness H1 of the fixing belt was about 500 $N/mm^2$. The hardness H2 of the glass surface of the heater was about 3500 $N/mm^2$.

The elastic power and a universal hardness were measured using a surface film physical property tester Fischer Scope H-100® manufactured by Fischer Instruments K.K., and ten point average roughness (Rz) was measured using a surface profile measuring instrument Surfcom 1400D® manufactured by Tokyo Seimitsu Co., Ltd.

Present inventors made some fixing belts having the elastic powers from 45% to 65% and the relationship of H1<H2 where H1 is the hardness of the base including the sliding surface of the fixing belt, and H2 is the hardness of the glass of the heater surface. The present inventors performed durability tests to investigate the wear resistance of each of the fixing belts. When the fixing belt worn after the durability test did not affect the image quality, the wear of the fixing belt was evaluated as a grade 4. When the fixing belt worn after the durability test causes a minimal abnormal image that was practically usable level, the wear of the fixing belt was evaluated as a grade 3.

In general, using the soft lubricant having the high consistency accelerates deterioration of the inner portion of the fixing belt, and using the hard lubricant having the low consistency improves the deterioration. However, when the hard lubricant is used, there is a risk that abrasion powder generated by sliding increases sliding resistance and causes no margin with respect to the driving force limit to drive the fixing device (as a result, a motor in the main body may stop due to torque over).

To avoid the torque over and use the hard lubricant, an expensive motor and expensive gears are selected to provide sufficient driving force. In addition, the increase of the torque may prevent the fixing belt from being smoothly rotated by the pressure roller, which may cause creases in the sheet or sheet jam.

Even under the condition that the hardness H2 of a portion having the slide surface of the secured member (that is the heater in the present embodiment) was larger than the hardness H1 of the base having the sliding surface of the fixing belt, the wear of the inner portion of the fixing belt varied depending on the elastic power. From the test results illustrated in FIG. 7, it can be seen that setting the elastic power to be 55% or more can ensure practical wear resistance performance.

In addition, setting the elastic power to be 58% or more can ensure high quality wear resistance. In other words, using the fixing belt having a large elastic power enables the use of the soft lubricant, which means that various types of grease can be used. In addition, setting the elastic power to be 63% or more can farther prevent the wear of the inner portion of the fixing belt to provide a high-quality image and extend the life of the fixing belt which has been determined by the wear.

When the hard lubricant is used, shear stress acts on the lubricant between the fixing belt and the secured member, increasing the sliding resistance. Increasing the sliding resistance increases the driving torque of the pressure roller and the load on the driving gears and the motor. To drive the pressure roller having the large torque, expensive driving system components are selected. Enabling the use of the soft lubricant reduces the cost of the driving system and the wear of the fixing belt.

The elastic power indicates how much the object returns when no force is applied to the object after the force is applied to the object. The object having a large elastic power 1, easily returns to the original form when no force is applied to the object after the force is applied. Preferably, the inner portion of the fixing belt sliding on the secured member is made so that change of the force caused by the sliding does not generate a permanent distortion of the inner portion of the fixing belt.

(Printing Durability)

Figure 8:
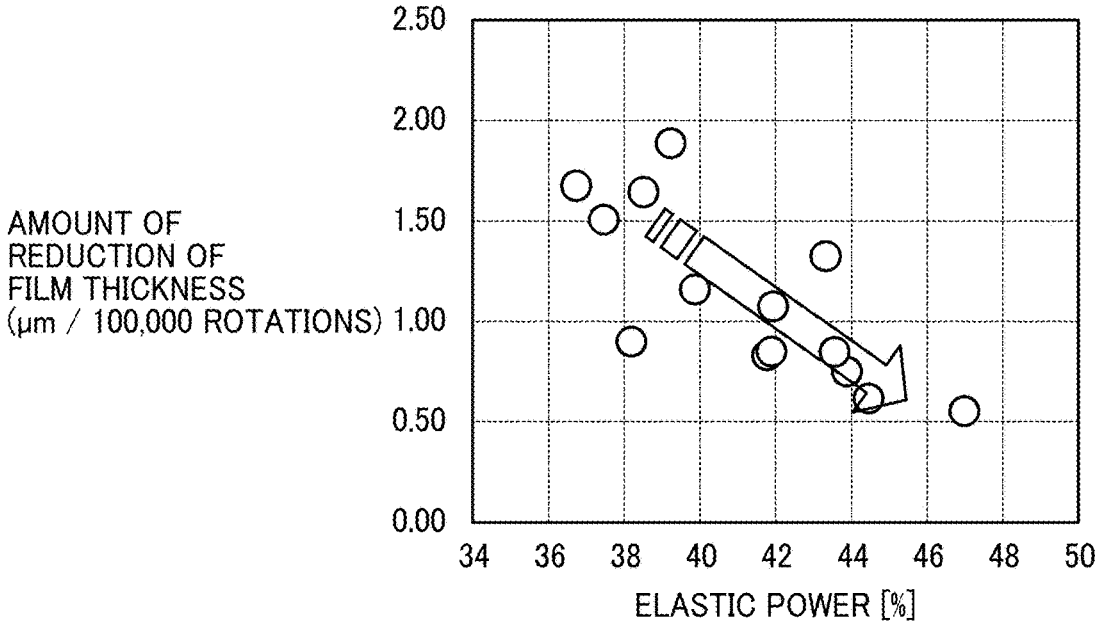
FIG. 8 is a graph illustrating a correlation between the elastic power and a film thickness loss.

FIG. 8 is a graph illustrating a correlation between elastic power and film thickness loss. A plurality of plot points in FIG. 8 are results of printing durability tests using fixing belts including inner portions having different elastic powers. The durability printing tests were performed under ordinary temperature and ordinary humidity environment that was at a temperature of 25° C. and a relative humidity of 50%. In the image forming apparatus illustrated in FIG. 1A, the same images of a document including characters were formed on the four photoconductor drums. The image forming apparatus formed the images on 100,000 sheets of recording media.

The film thicknesses of the inner portion of the fixing belt were measured at the start of printing durability test and after image formation on 100,000 sheets of recording media. The difference between the film thicknesses was calculated as the film thickness loss. The film thickness was measured by a film thickness measurement apparatus (trade name: Fischer Scope MMS manufactured by Fischer Instruments K.K.).

It was found that increasing the elastic power decreases the film thickness loss and improves the printing durability. The film thickness loss of the fixing belt having the elastic power of 55% or more was almost negligible.

(State of Lubricant Held on Secured Member)

Figure 9B:
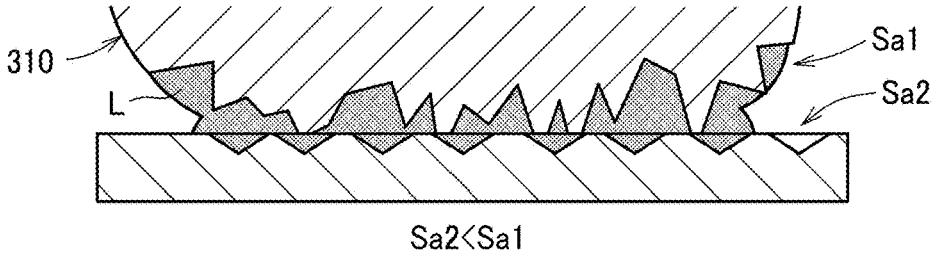

FIGS. 9A and 9B are diagrams illustrating lubricant held between the fixing belt and the heater that have different surface roughness. In FIGS. 9A and 9B, Sa1 is the roughness of the inner circumferential surface of the fixing belt, and Sa2 is the roughness of the slide surface (that is the surface of the insulation layer) of the heater. FIG. 9A illustrates a cross-section of the fixing belt and a cross section of the heater when Sa1<Sa2.

FIG. 9A illustrates that the lubricant tends to transfer from the fixing belt to the heater because the roughness Sa2 of the surface of the heater is larger than the roughness Sa1 of the inner circumferential surface of the fixing belt. In contrast, FIG. 9B illustrates a cross-section of the fixing belt and the cross section of the heater when Sa2<Sa1 that is the opposite of the relation of the surface roughness in FIG. 9A. FIG. 9B illustrates that the lubricant tends to transfer from the heater to the fixing belt because the roughness Sa1 of the fixing belt is larger than the roughness Sa2 of the surface of the heater.

It can be seen from FIGS. 9A and 9B that increasing the roughness Sa1 of the inner circumferential surface of the fixing bell so as to be Sa2<Sa1 is advantageous for maintaining the amount of the lubricant on the inner surface of the fixing belt. In addition, it was found from the results of the film thickness losses in FIG. 8 that setting the elastic power to be 55% or more is advantageous for maintaining the above-described magnitude relationship of the surface roughness over time.

(Types of Surface Shape Parameters)

Parameters of the surface shape relating to sliding on something and abnormal noise during the sliding include arithmetic average roughness Sa, valley void volume Vvv, skewness Ssk, and kurtosis Sku. The following describes each parameter.

(Arithmetic Average Roughness)

Figure 10A:
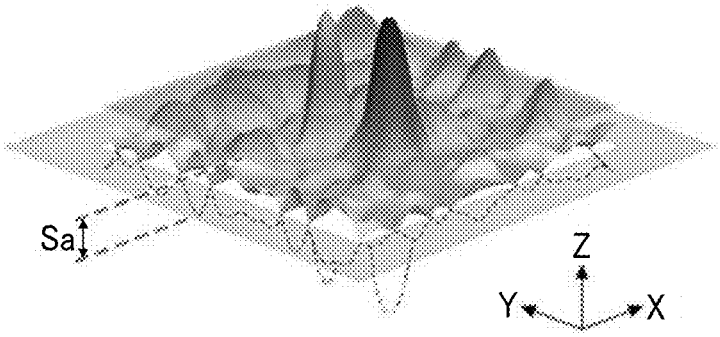
FIG. 10A is a diagram illustrating an arithmetic average roughness.

FIG. 10A is a diagram illustrating the arithmetic average roughness. The arithmetic average roughness Sa is a parameter obtained by three dimensionally expanding a contour curve (in other words, a line roughness) parameter Ra. In FIG. 10A, the arithmetic average roughness is an average of absolute values of Z (x, y) (that is, height differences from an average plane) in a measurement target region.

(Material Ratio Curve)

Figure 10B:
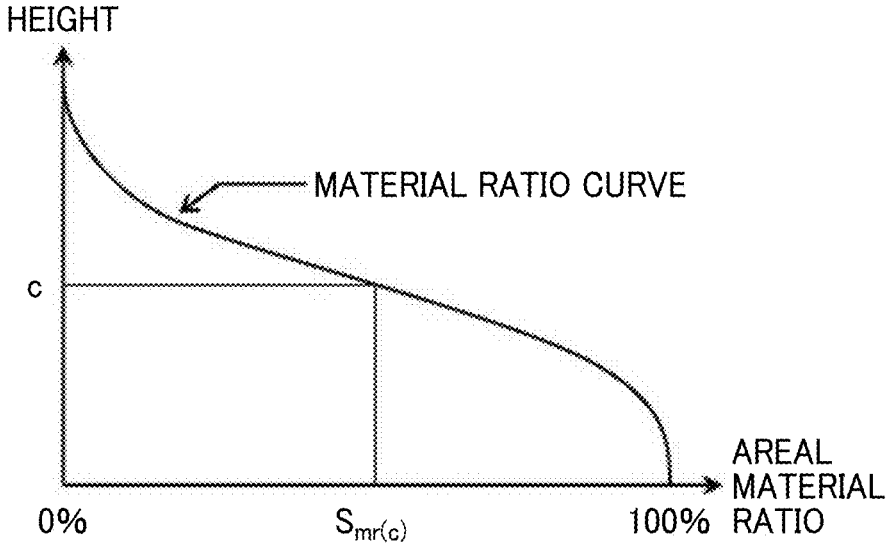
FIG. 10B is a graph illustrating a material ratio curve.

The valley void volume Vvv represents the void volume of valleys at an areal material ratio p %. FIG. 10B is a graph illustrating a material ratio curve.

In order to calculate the valley void volume Vvv, the material ratio curve of a surface is obtained. The material ration curve represents heights where the areal material ratio is from 0% to 100%. The areal material ratio represents an area of a region having a certain height c or more. The areal material ratio at the height c corresponds to Smr (c) in FIG. 10B.

The valley void volume Vvv is calculated from the material ratio curve as a volume of region where the areal material ratio is from p % to 100%. The present inventors use p=80% to calculate the valley void volume Vvv.

(Material Volume and Void Volume)

Figure 10C:
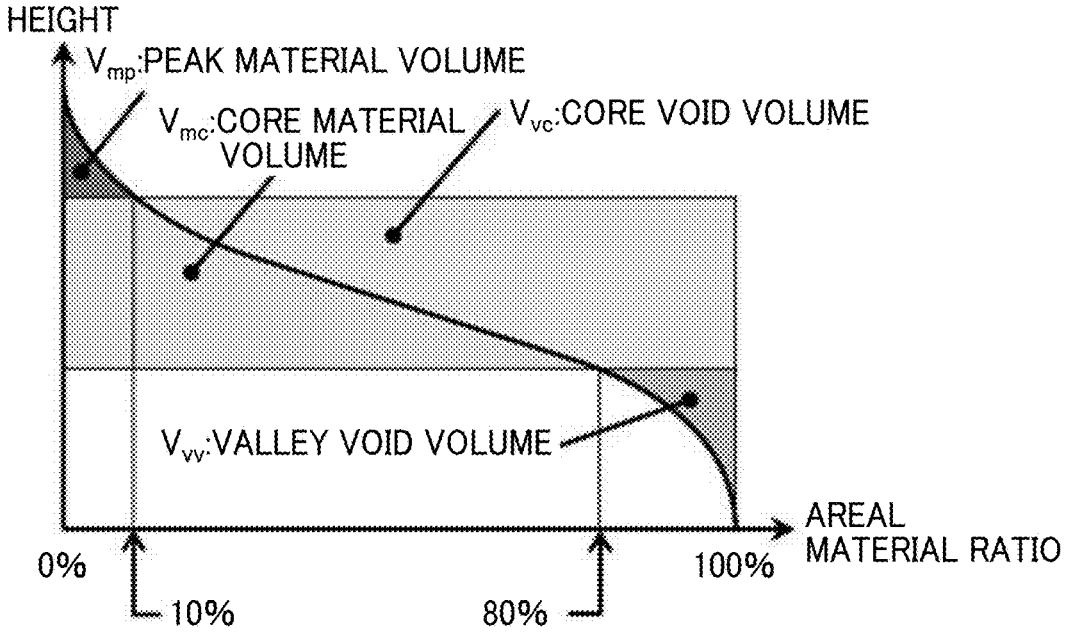
FIG. 10C is a graph illustrating a material ratio curve representing a material volume and avoid volume.

FIG. 10C is a graph illustrating the material ratio curve representing a material volume and a void volume. As the valley void volume Vvv increases, the volume of the valley increases, which means that the surface can hold more lubricant. As a result, such surface can have improved wear resistance.

(Height Distributions in Different Skewness)

Figure 10D:
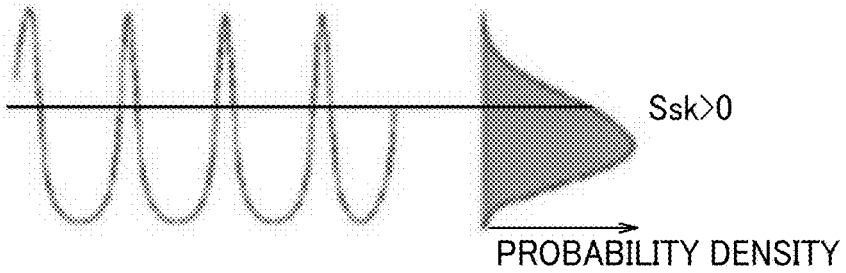
FIG. 10D is a graph illustrating a height distribution of a surface with a skewness Ssk larger than zero and a schematic sectional view of the surface.
Figure 10E:
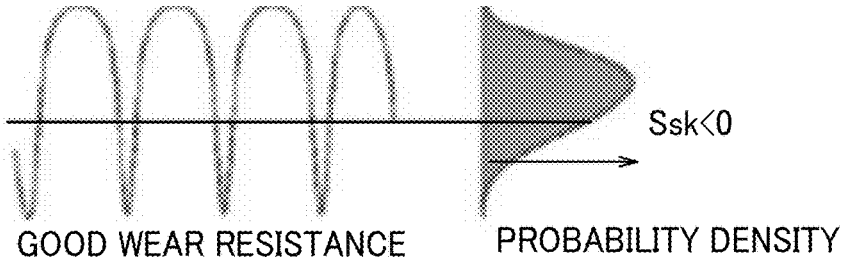
FIG. 10E is a graph illustrating a height distribution of a surface with the skewness Ssk smaller than zero and a schematic sectional view of the surface.

FIGS. 10D and 10E illustrate height distributions in different skewness Ssk. FIG. 10D illustrates a height distribution in the skewness Ssk that is larger than zero, that is, Ssk>0. FIG. 10E illustrates a height distribution in the skewness Ssk that is smaller than zero, that is, Ssk<0.

The skewness Ssk represents the symmetry of the height distribution and is calculated by the following expression 1.

$$S_{sk} = \frac{1}{S_q^3}\left[\frac{1}{A}\int\int_A z^3(x, y)dxdy\right] \quad \text{Expression 1}$$

The height distribution with Ssk=0 is vertically symmetrical. When Ssk>0, the surface has many fine mountains as illustrated in FIG. 10D. When Ssk<0, the surface has many fine mountains as illustrated in FIG. 10E.

The surface having many fine mountains as illustrated in FIG. 10E has a larger contact area in contact with the sliding surface than the surface as illustrated in FIG. 10D. Therefore, forming the surface as illustrated in FIG. 10E improves the wear resistance. Since the wear resistance is improved as the skewness Ssk is smaller, the skewness Ssk as the surface shape parameter of the sliding surface of the fixing belt is preferably equal to or smaller than zero.

(Kurtosis)

Kurtosis Sku represents the sharpness of the height distribution and is calculated by the following expression 2.

$$S_{ku} = \frac{1}{S_q^4}\left[\frac{1}{A}\int\int_A z^4(x, y)dxdy\right] \quad \text{Expression 2}$$

Figure 10F:
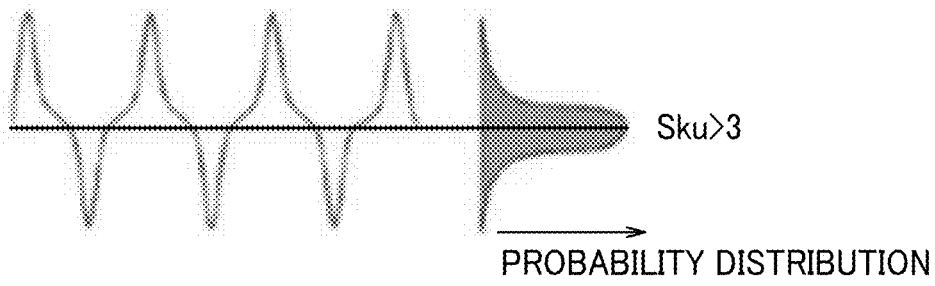
FIG. 10F is a graph illustrating a height distribution of a surface with a kurtosis Sku larger than three and a schematic sectional view of the surface.
Figure 10G:
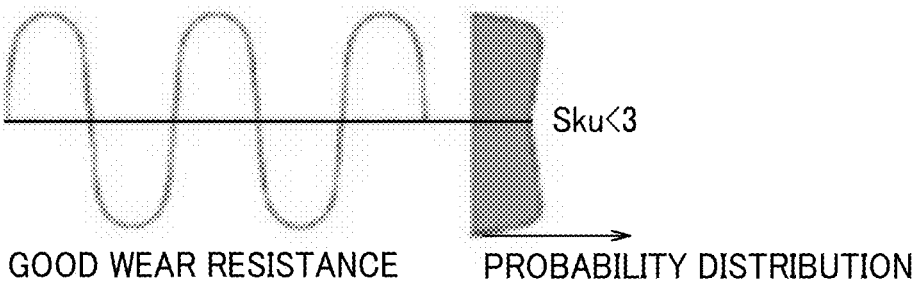
FIG. 10G is a graph illustrating a height distribution of a surface with the kurtosis Sku smaller than three and a schematic sectional view of the surface.

When Sku=3, the height distribution is a normal distribution. When Sku>3, the surface has many sharp mountains and valleys as illustrated in FIG. 10F When Sku<3, the surface becomes flat as illustrated in 10G, and the contact area in contact with the sliding surface increases. Therefore, the wear resistance becomes good.

In other words, the surface having a large skewness Ssk (in particular Ssk>0) or a large kurtosis Sku (in particular Sku>3) has a large number of projections. When the inner circumferential surface of the fixing belt slides on the secured member such as the heater, the projections on the inner circumferential surface receive loads and wear. Therefore, the amount of wear of the fixing belt having the inner circumferential surface with many projections is larger than the amount of wear of the fixing belt with a small number of projections. The surface with many projections is easily damaged. In addition, an increase in the wear amount leads to an increase in abrasion powder. The abrasion powder is mixed with the grease, increases the viscosity of the grease, and makes it difficult for the grease to enter between the inner circumferential surface of the fixing belt and the secured member such as the heater. Therefore, it is desirable to reduce the skewness Ssk and kurtosis Sku (especially setting Ssk<0, Sku<3).

(Measurement Method)

The surface shape parameters is measured by a VK-X100® manufactured by Keyence Corporation using a 50× objective lens. The sample of the fixing belt was measured after the fixing belt was set on a flat surface and confirmed that there was no large inclination or waviness at an observation position.

(Relation Between Elastic Power and Friction Coefficient)

The elastic power is represented by the area of the displacement-load curve during loading and the area of the displacement-load curve during unloading that each mean an energy loss as illustrated in FIG. 5D. As the difference between these areas are larger, a frictional force (in other words, a torque to rotate the fixing belt) increases. FIG. 11A is a graph illustrating a relation between the elastic power and coefficients of static and kinetic friction of the fixing belt. Changing the elastic power changes the coefficients of static and kinetic friction. The difference between the coefficient of static friction and the coefficient of kinetic friction becomes smaller as the elastic power becomes larger.

The present inventors made fixing belts having the elastic power of 50%, 55%, and 63%, measured coefficients of friction of the fixing belts as follows, and obtained the results as illustrated in FIG. 11A.

The coefficient of kinetic friction was measured as follows.

A small amount of grease was applied to the inner circumferential surface of the fixing belts described above. The grease was HP300 manufactured by Toray Industries, Inc., and the small amount was 50 mg. The fixing belt was cut out to make a sample. The sample was set on a ring-on tester. The coefficient of kinetic friction was measured for 24 hours, and the average value was calculated as the coefficient of kinetic friction of the sample.

Abutment made of glass and having a diameter of 10 mm was set.

The ring was rotated by a rotational speed (that is a speed of measurement unit) of 250 mm/sec.

Temperature was maintained to be 23° C.

Load 1 kg/cm$^2$ was applied to the sample.

The coefficient of static friction was measured as follows. The fixing belt was cut out to make a sample. No grease was applied to the fixing belt. The sample was set on the ring-on tester.

Abutment made of glass and having a diameter of 10 mm was set.

Temperature was maintained to be 23° C.

Load 1 kg/cm$^2$ was applied to the sample.

The present inventors also evaluated the occurrence of abnormal noise and vibration during the measurement of the coefficient of kinetic friction described above. The present inventors determined that the abnormal noise occurred when the present inventors heard the abnormal noise during the measurement of the coefficient of kinetic friction. The present inventors determined that the abnormal vibration occurred when a disturbance is intermittently found in the waveform measured during the measurement of the coefficient of kinetic friction. FIG. 11B is a table illustrating the results of the above investigation. According to this experiment, even if the elastic power is changed (50% →55% →63%), it seems that there is no change in the abnormal noise. However, the vibration is a predictor of the abnormal noise. From the results in FIG. 11B, the present inventors found that increasing the elastic power prevents the occurrence of the vibration and the abnormal noise of the fixing belt.

That is, setting the elastic power to 55% improves the elastic deformability of the fixing belt and relaxes the stress during sliding, which ensures practical wear resistance performance (that is, deterioration prevention of the belt) and favorably prevents the abnormal noise and vibration. In addition, setting the elastic power to 63% farther improves the elastic deformability of the fixing belt and farther relaxes the stress during sliding, which ensures high quality wear resistance performance (that is, deterioration prevention of the belt) and more favorably prevents the abnormal noise and vibration.

Generally, the hardness (Martens hardness) of the fixing belt surface is simply increased in order to improve the wear resistance of the fixing belt, but increasing the hardness of the fixing belt does not prevent the deterioration of the fixing belt in reality. Increasing the elastic power of the inner portion of the fixing belt relaxes the stress in the inner portion of the fixing belt that is a nip sliding portion and gives an effect of preventing deterioration of the member structure.

FIG. 11C is a graph illustrating a relation between the elastic power and a difference between the coefficient of static friction and the coefficient of kinetic friction that are illustrated in FIG. 11A. As is clear from FIG. 11C, the difference between the coefficient of static friction and the coefficient of kinetic friction is 0.14 or less when the elastic power is 55% or more. As the difference between the friction coefficients is smaller, the stick-slip phenomenon can be prevented, and the occurrence of abnormal noise and vibration can be prevented.

(Other Embodiments of Image Forming Apparatus)

The image forming apparatus according to the present embodiment of this disclosure is applicable not only to a color image forming apparatus illustrated in FIG. 1A but also to a monochrome image forming apparatus such as a copier, printer, facsimile machine, or multifunction printer including at least two functions of the copier, printer, and facsimile machine.

Figure 12:
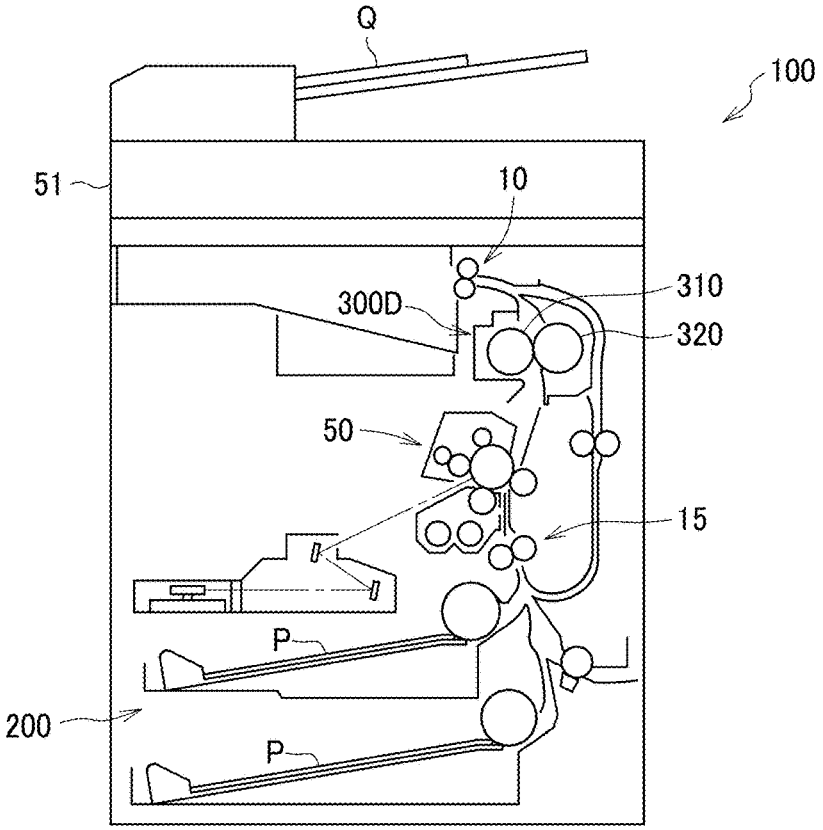
FIG. 12 is a schematic diagram illustrating a configuration of an image forming apparatus different from the image forming apparatus of FIG. 1A.

For example, as illustrated in FIG. 12, an image forming apparatus 100 according to the present embodiment includes an image forming device 50 including a photoconductor drum and the like, a sheet conveyer including a timing roller pair 115 and the like, a sheet feeder 200, a fixing device 300D, a sheet ejection device 110, and a reading device 51. The sheet feeder 200 includes a plurality of sheet feeding trays, and the sheet feeding trays stores sheets of different sizes, respectively.

The reading device 51 reads an image of a document Q. The reading device 51 generates image data from the read image. The sheet feeder 200 stores a plurality of sheets P and feeds the sheet P to a conveyance path. The timing roller pair 115 conveys the sheet P on the conveyance path to the image forming device 50.

The image forming device 50 forms a toner image on the sheet P. Specifically, the image forming device 50 includes the photoconductor drum, a charging roller, an exposure device, a developing device, a supply device, a transfer roller, a cleaning device, and a discharger. The toner image is, for example, an image of the document Q.

The fixing device 300D fixes the toner image on the sheet P by heating and pressing the toner image. Conveyance rollers convey the sheet P on which the toner image has been fixed to the sheet ejection device 110. The sheet ejection device 110 ejects the sheet P to the outside of the image forming apparatus 100.

Figure 13:
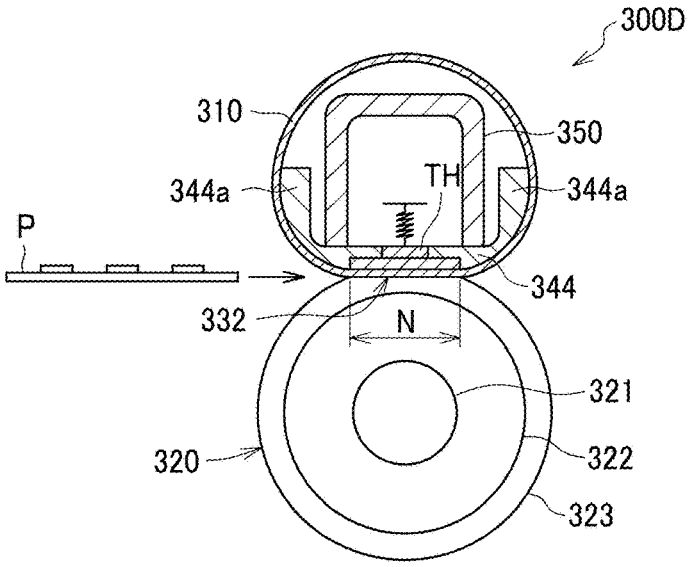
FIG. 13 is a schematic cross-sectional view of a fixing device having a configuration different from the fixing devices of FIGS. 2A to 2D.

Next, the fixing device 300D of the present embodiment is described. Description of configurations common to those of the fixing device 300 of the above-described embodiment is omitted as appropriate. As illustrated in FIG. 13, the fixing device 300D includes a fixing belt 310, a pressure roller 320, a heater 332, a heater holder 344, a stay 350, a thermistor TH, and the like.

A fixing nip N is formed between the fixing belt 310 and the pressure roller 320. The nip width of the fixing nip N is, for example, 10 mm, and the linear velocity of the fixing device 300D is, for example, 240 mm/s.

The fixing belt 310 includes a polyimide base and a release layer and does not include an elastic layer. The release layer is made of a heat-resistant film material made of, for example, a fluororesin. The outer diameter of the fixing belt 310 may be, for example, approximately 24 mm.

The pressure roller 320 includes the core 321, the elastic layer 322, and the release layer 323. The outer diameter of the pressure roller 320 may be, for example, 24 to 30 mm, and the thicknesses of the elastic layer 322 may be, for example, 3 to 4 mm.

The heater 332 includes the substrate, a thermal insulation layer, a conductor layer including the resistive heat generator and the like, and the insulation layer, and is formed to have, for example, 1 mm as a whole thickness. The width Y of the heater 332 in a direction intersecting an arrangement direction in FIG. 13 may be, for example, 13 mm.

Figure 14:
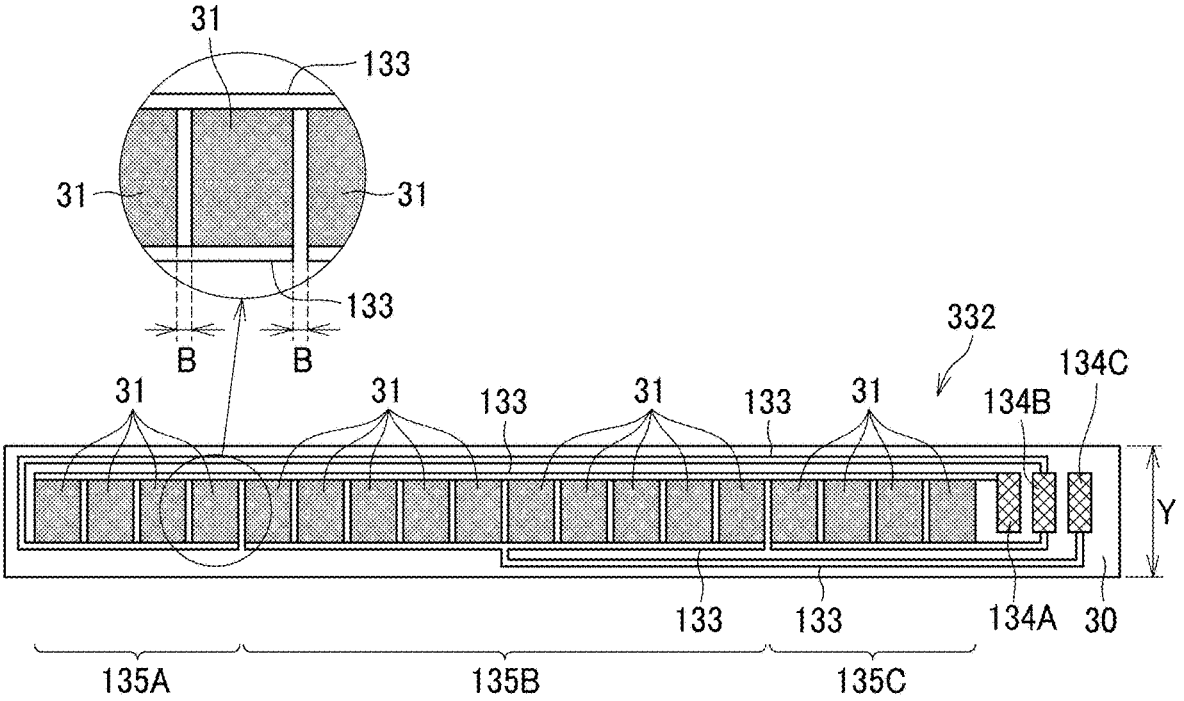
FIG. 14 is a plan view of a heater of the fixing device of FIG. 13.

As illustrated in FIG. 14, the conductor layer of the heater 332 includes a plurality of resistive heat generators 31 arranged in the arrangement direction, power supply lines 133, and electrodes 134A to 134C. As illustrated in the enlarged view of FIG. 13, the separation area B is formed between neighboring resistive heat generators of the plurality of resistive heat generators 31 arranged in the arrangement direction. The enlarged view of FIG. 14 illustrates two separation areas B, but the separation area B is formed between neighboring the resistive heat generators of all the plurality of resistive heat generators 31.

The resistive heat generators 31 configure three heat generation portions 135A to 135C. When a current flows between the electrodes 134A and 134C, the heat generation portions 135A and 135C generate heat.

When a current flows between the electrodes 134A and 134C, the heat generation portion 135B generates heat. When the fixing device 300D fixes the toner image onto the small sheet, the beat generation portion 135B generates heat. When the fixing device 300D fixes the toner image onto the large sheet, all the heat generation portions 135A to 135C generate heat.

Figure 15:
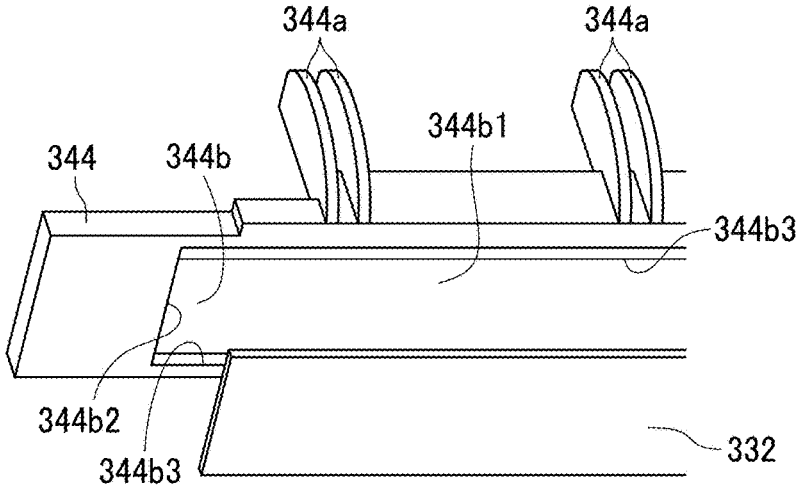
FIG. 15 is a partial exploded perspective view of the heater of FIG. 13 and a holder.

As illustrated in FIG. 15, the heater holder 344 holds the heater 332 in a recessed portion 344*b* of the heater holder 344. The recessed portion 344*b* is formed on the side of the heater holder 344 facing the heater 332.

The recessed portion 344*b* has a bottom surface 344*b*1 and walls 344*b*2 and 344*b*3. The bottom surface 344*b*1 is substantially parallel to the substrate 30 and the surface recessed from the side of the heater holder 344 toward the stay 350. The walls 344*b*2 are both side surfaces of the recessed portion 344*b* in the arrangement direction. The recessed portion 344*b* may have one wall 344*b*2. The walls 344*b*3 are both side surfaces of the recessed portion 344*b* in the direction intersecting the arrangement direction. The heater holder 344 has guides 344*a*. The heater holder 344 is made of liquid crystal polymer (LCP).

Figure 16:
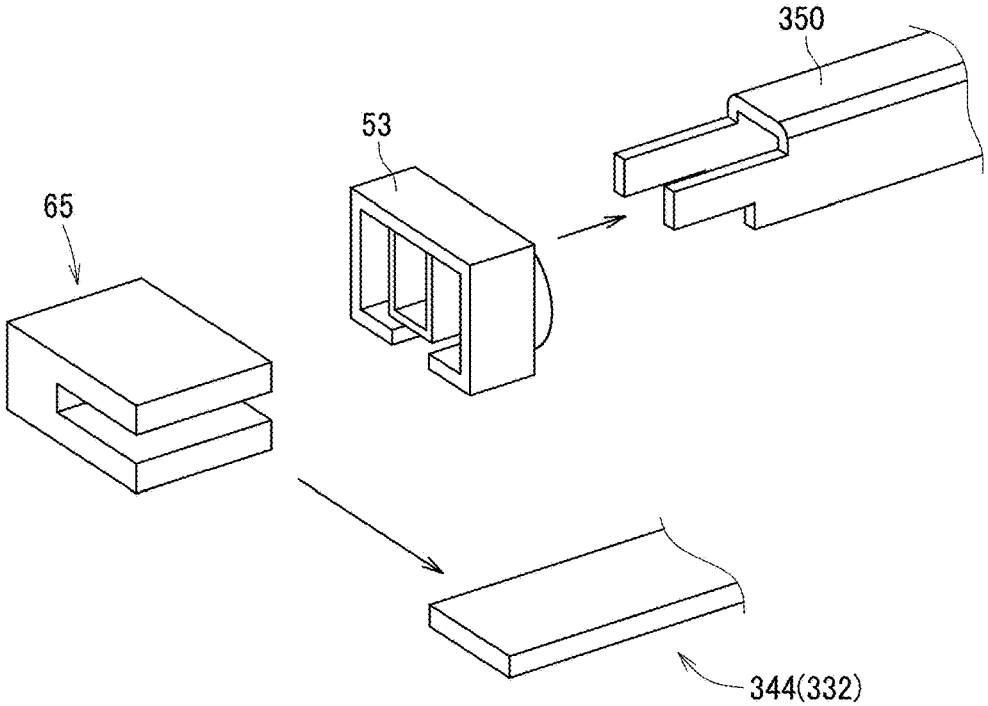
FIG. 16 is an exploded perspective view of the heater of FIG. 13, a connector, a flange, and a stay.

As illustrated in FIG. 16, the connector 65 includes a U-shaped housing made of resin such as LCP and a plurality of contact terminals fixed to the surface inside the U-shaped housing. The connector 65 is attached to the heater 332 and the heater holder 344 such that a front side of the heater 332 and the heater holder 344 and a back side of the heater 332 and the heater holder 344 are sandwiched by the connector 65.

In this state, the contact terminals contact and press against the electrodes of the heater 332, respectively and the heat generation portions 135 are electrically connected to the power supply provided in the image forming apparatus via the connector 65. The above-described configuration enables the power supply to supply power to the heat generation portions 135. Note that at least part of each of the electrodes 134 is not coated by the insulation layer and therefore exposed to secure connection with the connector 65.

The flanges 53 hold both ends of the fixing belt 310. The flange 53 contacts the inner circumferential surface of the fixing belt 310 at each of both ends of the fixing belt 310 in the arrangement direction to hold the fixing belt 310. The flange 53 is fixed to a housing of the fixing device 300D. The flanges 53 are inserted into both ends of the stay 350 (see a direction indicated by arrow from the flange 53 in FIG. 16).

To attach to the heater 332 and the heater holder 344, the connector 65 is moved in the direction intersecting the arrangement direction (see a direction indicated by arrow from the connector 65 in FIG. 16). The connector 65 and the heater holder 344 may have a convex portion and a recessed portion to attach the connector 65 to the heater holder 344. The convex portion disposed on one of the connector 65 and the heater holder 344 is engaged with the recessed portion disposed on the other and relatively move in the recessed portions to attach the connector 65 to the heater holder 344. The connector 65 is attached to one end of the heater 332 and one end of the heater holder 344 in the arrangement direction. The one end of the heater 332 and one end of the heater holder 344 are farther from a portion in which the pressure roller 320 receives a driving force from a drive motor than the other end of the heater 332 and the other end of the heater holder 344, respectively.

Figure 17:
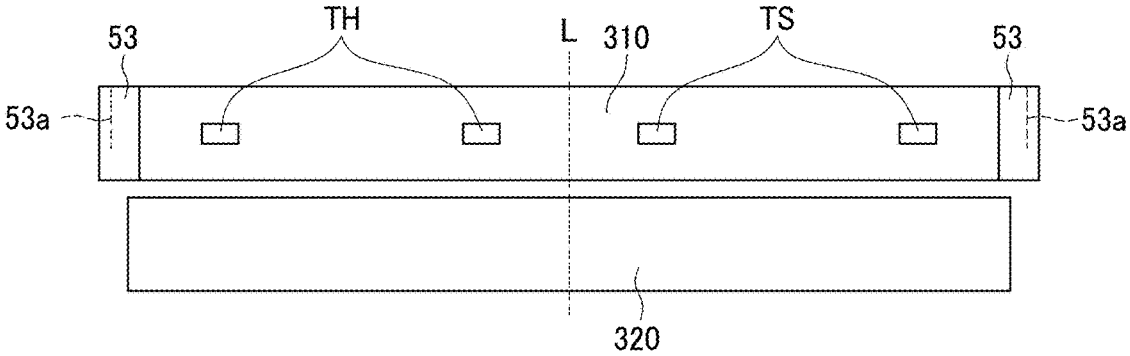
FIG. 17 is a diagram illustrating an arrangement of thermistors.

As illustrated in FIG. 17, one thermistor TH faces a center portion of the inner circumferential surface of the fixing belt 310 in the arrangement direction, and another thermistor TH faces an end portion of the inner circumferential surface of the fixing belt 310 in the arrangement direction. The heater 332 is controlled based on the temperature of the center portion of the fixing belt 310 and the temperature of the end portion of the fixing belt 310 in the arrangement direction that are detected by the thermistors TH. Any one of the thermistors TH is disposed corresponding to the separation area between neighboring the resistive heat generators of the heater 332.

One thermostat TS faces a center portion of the inner circumferential surface of the fixing belt 310 in the arrangement direction, and another thermostat TS faces an end portion of the inner circumferential surface of the fixing belt 310 in the arrangement direction. Each of the thermostats TS shuts off a current flowing to the heater 332 in response to a detection of a temperature of the fixing belt 310 higher than a predetermined threshold value.

Flanges 53 are disposed at both ends of the fixing belt 310 in the arrangement direction and hold both ends of the fixing belt 310, respectively. The flange 53 is made of liquid crystal polymer (LCP).

Figure 18:
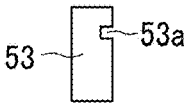
FIG. 18 is a schematic diagram illustrating a slide groove of the flange.

As illustrated in FIG. 18, the flange 53 has a slide groove 53*a*. The slide groove 53*a* extends in a direction in which the fixing belt 310 moves toward and away from the pressure roller 320.

An engaging portion of a housing of the fixing device 300D is engaged with the slide groove 53*a*. The relative movement of the engaging portion in the slide groove 53*a* enables the fixing belt 310 to move toward and away from the pressure roller 320.

Although some embodiments of the present disclosure have been described above, embodiments of the present disclosure are not limited to the embodiments described above, and a variety of modifications can be made within the scope of the present disclosure. For example, the pressure roller 320 as a pressing member of the fixing device 3M) may be a pressing belt stretched between two rotators. Other heat generators such as a ceramic heater may be used as the heat generator of the fixing device 300, In the above, the thermistor and the thermostat detect the temperature of the fixing belt but may detect the temperature of the resistor that generates heat.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. The number, position, and shape of the components described above are not limited to those embodiments described above. Desirable number, position, and shape can be determined to perform the present disclosure.

What is claimed is:

1. A pressing device comprising:

a rotator having flexibility and a sleeve form, the rotator including an inner portion having a sliding surface, the inner portion having an elastic power of 55% or more;

a secured structure being disposed inside a loop of the rotator, the secured structure having a slide surface on which the sliding surface of the rotator is to slide, the slide surface having a larger hardness than a hardness of the sliding surface of the rotator;

a pressure rotator to press the rotator against the secured structure and form a nip between the rotator and the pressure rotator; and lubricant provided between the rotator and the secured structure, wherein the slide surface of the secured structure has an arithmetic average roughness of 0.05 μm or less.

2. The pressing device according to claim 1, wherein the elastic power of the inner portion of the rotator is 63% or more.

3. The pressing device according to claim 1, wherein the secured structure includes a heater.

4. The pressing device according to claim 3, wherein the heater is a planar heater including heat generators arranged in a longitudinal direction of the heater.

5. The pressing device according to claim 1, wherein the lubricant includes at least one of fluorine grease or silicone oil.

6. The pressing device according to claim 1, wherein the inner portion of the rotator includes polyimide.

7. The pressing device according to claim 1, wherein the sliding surface of the rotator has an arithmetic average roughness of 0.2 μm or more.

8. The pressing device according to claim 1, wherein the sliding surface of the rotator has a valley void volume of 0.01 $ml/m^2$ or more.

9. The pressing device according to claim 1, wherein the sliding surface of the rotator has a skewness equal to or smaller than zero.

10. The pressing device according to claim 1, wherein the sliding surface of the rotator has a kurtosis equal to or smaller than three.

11. The pressing device according to claim 1, wherein a portion including the slide surface of the secured structure is made of glass.

12. The pressing device according to claim 1, wherein the rotator comprises a base, a surface layer, and an adhesive layer.

13. The pressing device according to claim 1, wherein the pressure rotator includes a solid rubber and has a thermal conductivity from 0.2 to 2.5 W/m·k in a longitudinal direction of the pressure rotator.

14. The pressing device according to claim 1, wherein a difference between a coefficient of static friction and a coefficient of kinetic friction in the sliding surface of the rotator is 0.14 or less.

15. A fixing device comprising the pressing device according to claim 1.

16. An image forming apparatus comprising the fixing device according to claim 15.

* * * * *